US009653251B2

(12) United States Patent
Tang et al.

(10) Patent No.: US 9,653,251 B2
(45) Date of Patent: May 16, 2017

(54) X-RAY APPARATUS AND A CT DEVICE HAVING THE SAME

(71) Applicants: TSINGHUA UNIVERSITY, Beijing (CN); NUCTECH COMPANY LIMITED, Beijing (CN)

(72) Inventors: Chuanxiang Tang, Beijing (CN); Huaping Tang, Beijing (CN); Huaibi Chen, Beijing (CN); Wenhui Huang, Beijing (CN); Huayi Zhang, Beijing (CN); Shuxin Zheng, Beijing (CN)

(73) Assignees: Temple University, Beijing (CN); Nuctech Company Limited, Beijing (CN)

( * ) Notice: Subject to any disclaimer, the term of this patent is extended or adjusted under 35 U.S.C. 154(b) by 174 days.

(21) Appl. No.: 14/490,526

(22) Filed: Sep. 18, 2014

(65) Prior Publication Data

US 2015/0078532 A1 Mar. 19, 2015

(30) Foreign Application Priority Data

Sep. 18, 2013 (CN) ..... 2013 1 0426917
Sep. 18, 2013 (CN) ..... 2013 1 0600016
(Continued)

(51) Int. Cl.
*H01J 35/06* (2006.01)
*H01J 35/14* (2006.01)
(Continued)

(52) U.S. Cl.
CPC ..... *H01J 35/14* (2013.01); *H01J 35/06* (2013.01); *H01J 35/12* (2013.01); *H05G 1/32* (2013.01);
(Continued)

(58) Field of Classification Search
CPC ..... A61B 6/032; A61B 6/035; A61B 6/4007; A61B 6/4014; A61B 6/4021;
(Continued)

(56) References Cited

U.S. PATENT DOCUMENTS 5,142,652 A 8/1992 Reichenberger et al.
2003/0072407 A1* 4/2003 Mihara ..... A61B 6/032 378/4
2011/0286581 A1* 11/2011 Sprenger ..... H01J 35/04 378/113

FOREIGN PATENT DOCUMENTS

CN 101494150 A 7/2009
CN 101521136 A 9/2009
(Continued)

*Primary Examiner* — Jurie Yun
(74) *Attorney, Agent, or Firm* — McDermott Will & Emery LLP

(57) ABSTRACT

The present application provides an external thermionic cathode distributed x-ray apparatus, including a vacuum box which is sealed at its periphery, where the interior thereof is high vacuum; a plurality of electron transmitting units arranged in a linear array and installed on the side wall of the vacuum box, where each electron transmitting unit is independent to each other; an anode installed in the center inside the vacuum box, where in the direction of length, the anode is parallel to the orientation of the electron transmitting unit, and in the direction of width, the anode has a predetermined angle with respect to the plane of the electron transmitting unit; a power supply and control system having a high voltage power supply and a focusing power supply; and a transmitting control means and a control system.

21 Claims, 12 Drawing Sheets

(30) Foreign Application Priority Data

Sep. 18, 2013 (CN) ..... 2013 1 0600023
Sep. 18, 2013 (CN) ..... 2013 1 0600370

(51) Int. Cl.
*H01J 35/12* (2006.01)
*H05G 1/32* (2006.01)
*H01J 35/16* (2006.01)

(52) U.S. Cl.
CPC ..... *H01J 35/16* (2013.01); *H01J 2235/068* (2013.01); *H01J 2235/086* (2013.01); *H01J 2235/087* (2013.01)

(58) Field of Classification Search
CPC ..... A61B 6/4028; H01J 35/02; H01J 35/04; H01J 35/045; H01J 35/06; H01J 35/065; H01J 35/08; H01J 35/14; H01J 35/16; H01J 2235/06; H01J 2235/062; H01J 2235/068; H01J 2235/086; H05G 1/52
USPC ..... 378/4, 9, 10, 122, 123, 124, 134, 136, 378/137, 138
See application file for complete search history.

(56) References Cited

FOREIGN PATENT DOCUMENTS

| | | | |
|---|---|---|---|
| CN | 101569529 | A | 11/2009 |
| CN | 102222594 | A | 10/2011 |
| CN | 102299036 | A | 12/2011 |
| CN | 102498540 | A | 6/2012 |
| CN | 102811544 | A | 12/2012 |
| CN | 102938359 | A | 2/2013 |
| CN | 203563254 | U | 4/2014 |
| CN | 203590580 | U | 5/2014 |
| CN | 203734907 | U | 7/2014 |
| DE | 102009017649 | A1 | 10/2010 |

* cited by examiner

X-RAY APPARATUS AND A CT DEVICE HAVING THE SAME

TECHNICAL FIELD

The present application relates to an apparatus generating distributed x-ray, in particular to an external thermionic cathode distributed x-ray apparatus generating x-ray altering the position of focus in a predetermined order in a x-ray light source device by arranging a plurality of independent thermionic cathode electron transmitting units via an external approach and by cathode control or grid control and a CT device having the external thermionic cathode distributed x-ray apparatus.

BACKGROUND

In general, x-ray light source refers to a device generating x-ray which is usually composed of x-ray tube, power supply and control system, auxiliary apparatus for cooling and shielding etc. or the like. The core of the device is the x-ray tube. The X-ray tube usually consists of cathode, anode, glass or ceramic housing etc. The cathode is a directly-heated spiral tungsten filament. When in operation, it is heated to a high-temperature state by current, thus generating thermal-transmitted electronic beam current. The cathode is surrounded by a metal cover having a slit in the front end thereof and focusing the electrons. The anode is a tungsten target inlayed in the end surface of the copper billet. When in operation, a high pressure is applied between the cathode and anode. The electrons generated by the cathode move towards the anode under the effect of electric field and ram the surface of the target, thereby the x-ray is generated.

X-ray presents a wide range of applications in the fields of nondestructive detection, security check and medical diagnoses and treatment etc. In particular, the x-ray fluoroscopic imaging device utilizing the high penetrability of the x-ray plays a vital role in every aspect of people's daily lives. The early device of this type is a film flat fluoroscopic imaging device. Currently, the advanced technology is digital, multiple visual angles and high resolution stereoscopic imaging device, e.g. CT (computed tomography), being able to obtain three-dimensional graphs or slice image of high definition, which is an advanced application.

In the current CT device, the x-ray source and the detector need to move on the slip ring. In order to increase the speed of inspection, the moving speeds of x-ray source and the detector are normally high leading to a decreased overall reliability and stabilization. In addition, due to the limit of moving speed, the inspection speed of the CT is limited accordingly. Therefore, there is a need for the x-ray source generating multiple visual angles without displacing.

To address the problems of reliability, stabilization and inspection speed caused by the slip ring as well as the heat resistance problem of the anode target spot, there are methods provided in the available patent literature. For example, rotating target x-ray source can solve the overheat of the anode target to some extent. However, its structure is complex and the target spot generating x-ray is still a definite target spot position with respect to the overall x-ray source. For instance, in some technology, a plurality of dependent conventional x-ray sources are arranged closely in a periphery to replace the movement of x-ray source in order to realize multiple visual angles of a fixed x-ray source. Although multiple visual angles can be realized, the cost is high. In addition, the space between the target spots of different visual angles is big and the imaging quality (stereoscopic resolution) is quite poor. What's more, a light source generating distributed x-ray and the method thereof is disclosed in the patent literature 1 (U.S. Pat. No. 4,926,452), wherein the anode target has a large area remitting the overheat of the target and multiple visual angles could be produced since the position of target spot changes along the periphery. Although the patent literature 1 performs scanning deflection to the accelerated high-energy electron beam, there are still problems of difficult control, non-disjunction of target spots and poor repeatability. Anyway, it is still an effective way to generate distributed light sources. Moreover, the light sources generating distributed x-ray and methods thereof are proposed in the patent literature 2 (US20110075802) and patent literature 3 (WO2011/119629), wherein the anode target has a large area remitting the overheat of the target and multiple visual angles could be produced since the position of target spots are fixed dispersedly and are arranged in an array. In addition, CNTs (carbon nano tubes) are employed as cold cathodes and the cold cathodes are arranged in an array. The transmitting is controlled by utilizing the voltage between cathode and grid so as to control each cathode to emit electron in sequence and bombard the target spot on the anode in an order correspondingly, thus becoming the distributed x-ray source. However, there are disadvantages of complex manufacturing process and poor transmitting capability and short lifetime of carbon nano tubes.

SUMMARY

The present application is proposed to address the above-mentioned problems, the aim of which is to provide an external thermionic cathode distributed x-ray apparatus and a CT device having the same in which multiple visual angles can be generated without moving the light source. This contributes to simplify the structure, enhance the stability and reliability of the system, hence increasing the efficiency of inspection.

To achieve the above-mentioned aim, the present application provides an external thermionic cathode distributed x-ray apparatus comprises: a vacuum box which is sealed at its periphery, and the interior thereof is high vacuum; a plurality of electron transmitting units arranged in a linear array and installed on the side wall of the vacuum box, each electron transmitting unit is independent to each other; an anode installed in the center inside the vacuum box, and in the direction of length, the anode is parallel to the orientation of the electron transmitting unit, and in the direction of width, the anode has a predetermined angle with respect to the plane of the electron transmitting unit; and a power supply and control system having a high voltage power supply connected to the anode, a transmitting control means connected to each of the plurality of the electron transmitting unit; a control system for controlling each power supply; the electron transmitting unit having: a heating filament; a cathode connected to the heating filament; a filament lead extending from both ends of the heating filament; an insulated support enclosing the heating filament and the cathode; a focusing electrode, arranged at the upper end of the insulated support by way of locating above the cathode; and a connecting fastener arranged above the focusing electrode and connected to the wall of the vacuum box; wherein, the filament lead is connected to the transmitting control means through the insulated support.

In addition, in the external thermionic cathode distributed x-ray apparatus of this disclosure, it further comprises: a high voltage power supply connecting means connecting the anode to the cable of the high voltage power supply and installed to the side wall of the vacuum box at the end adjacent to the anode, a connecting means of the transmitting control means for connecting the heating filament and the transmitting control means, a vacuum power supply included in the power supply and control system; a vacuum means installed on the side wall of the vacuum box maintaining high vacuum in the vacuum box utilizing the vacuum power supply.

In addition, in the external thermionic cathode distributed x-ray apparatus of this disclosure, the electron transmitting unit further comprises a grid installed between the cathode and the focusing electrode and adjacent to the cathode; a grid lead connected to the grid through the insulated support and connected to the transmitting control means.

In addition, in the external thermionic cathode distributed x-ray apparatus of this disclosure, the electron transmitting unit further comprises a focusing section installed between the focusing electrode and the connecting fastener; a focusing means arranged enclosing the focusing section.

In addition, in the external thermionic cathode distributed x-ray apparatus of this disclosure, it further comprises a focusing power supply included in the power supply and control system; a connecting means of the focusing means for connecting the focusing means and the focusing power supply.

In addition, in the external thermionic cathode distributed x-ray apparatus of this disclosure, the electron transmitting units are installed in two rows on the two side walls of the vacuum box opposing to each other.

In addition, in the external thermionic cathode distributed x-ray apparatus of this disclosure, the vacuum box is made of glass or ceramic.

In addition, in the external thermionic cathode distributed x-ray apparatus of this disclosure, the vacuum box is made of metal.

In addition, in the external thermionic cathode distributed x-ray apparatus of this disclosure, the plurality of the electron transmitting units are arranged in a straight line or segmented straight line.

In addition, in the external thermionic cathode distributed x-ray apparatus of this disclosure, the plurality of the electron transmitting units are arranged in an arc or segmented arcs.

In addition, in the external thermionic cathode distributed x-ray apparatus of this disclosure, the spaces between the electron transmitting units are uniform.

In addition, in the external thermionic cathode distributed x-ray apparatus of this disclosure, the spaces between the electron transmitting units are non-uniform.

In addition, this disclosure provides a CT device, characterized in that, the x-rays source used is the external thermionic cathode distributed x-ray apparatus as mentioned above.

According to this disclosure, it mainly provides an external thermionic cathode distributed x-ray apparatus generating x-rays changing the focus position periodically in a predetermined sequence in a light source device. By employing the thermionic cathode, the electron transmitting unit of this disclosure has the advantages of larger transmitting current, longer service life. A plurality of electron transmitting units are fixed to the vacuum box respectively and the pint-sized diode gun or triode gun may be used directly. The apparatus of this disclosure enjoys a mature technology, a low cost and a flexible application. The overheat of the anode is remitted by employing the design of big anode in the shape of strip thus improving the power of the light source. The electron transmitting units can be in a linear arrangement rendering the overall to be a linear distributed x-ray apparatus or in an annular arrangement rendering the overall to be an annular distributed x-ray apparatus, so as to have flexible applications. By the design of the focusing electrode and the external focusing apparatus, the electron beam can realize a very tiny focus. Compared with other distributed x-ray light source device, the one in this disclosure has the advantages of large current, small target spot, uniform target spots and high repeatability, high output power, simple structure, convenient control and low cost.

Applying the external thermionic cathode distributed x-ray apparatus to the CT device, multiple visual angles can be generated without moving the light source, and therefore the movement of slip ring could be omitted. This contributes to simplify the structure, enhance the stability and reliability of the system, hence increasing the efficiency of inspection.

DETAILED DESCRIPTION OF THE PREFERRED EMBODIMENTS

Hereinafter, detailed description of the present disclosure will be given in combination with the accompanying drawings.

Figure 1:
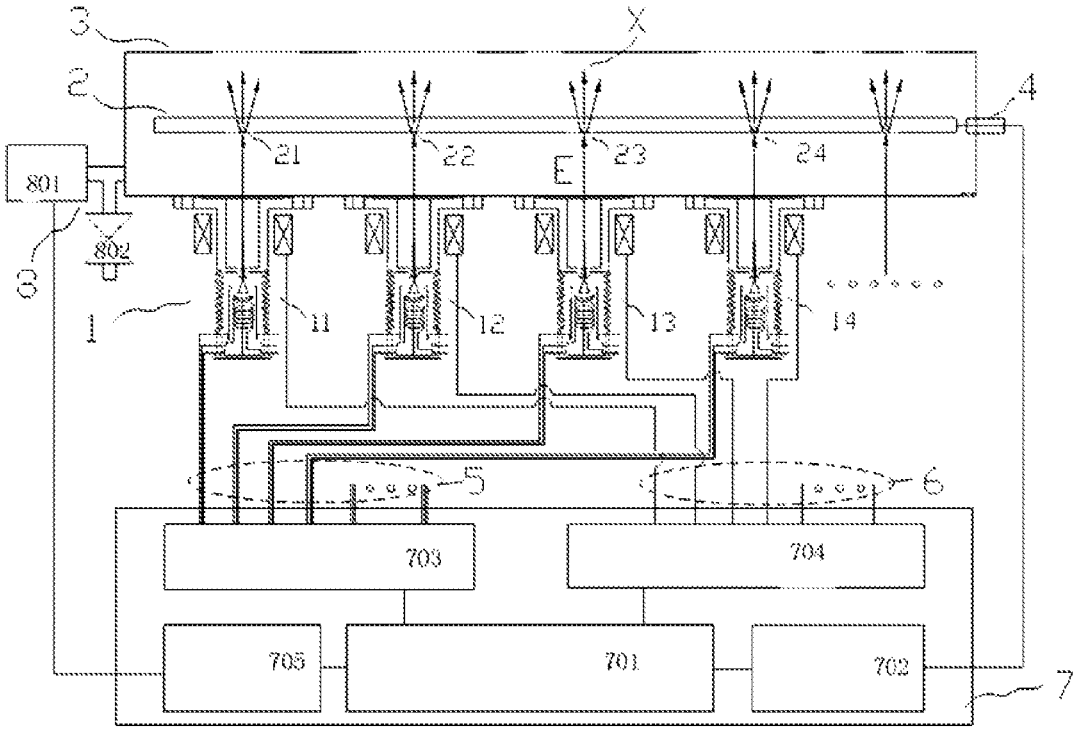
FIG. 1 is a schematic view of the structure of the external thermionic cathode distributed x-ray apparatus of the present application.

FIG. 1 is a schematic view of the structure of the external thermionic cathode distributed x-ray apparatus of the present application. As shown in FIG. 1, the external thermionic cathode distributed x-ray apparatus of the present application includes a plurality of electron transmitting units 1 (at least two, hereinafter also specifically referred to as electron transmitting unit 11, 12, 13, 14), an anode 2, a vacuum box 3, a high voltage power supply connecting means 4, a connecting means of the transmitting control means 5, and a power supply and control system 7. In addition, the electron transmitting unit 1 includes a heating filament 101, a cathode 102, an insulated support 103, a focusing electrode 104, a connecting fastener 105, a filament lead 106 etc. The anode 2 is installed in the middle inside the vacuum box 3. The electron transmitting unit 1 and the high voltage power supply connecting means 4 are installed on the wall of the vacuum box 3 and constitute an overall seal structure together with the vacuum box 3.

Figure 2:
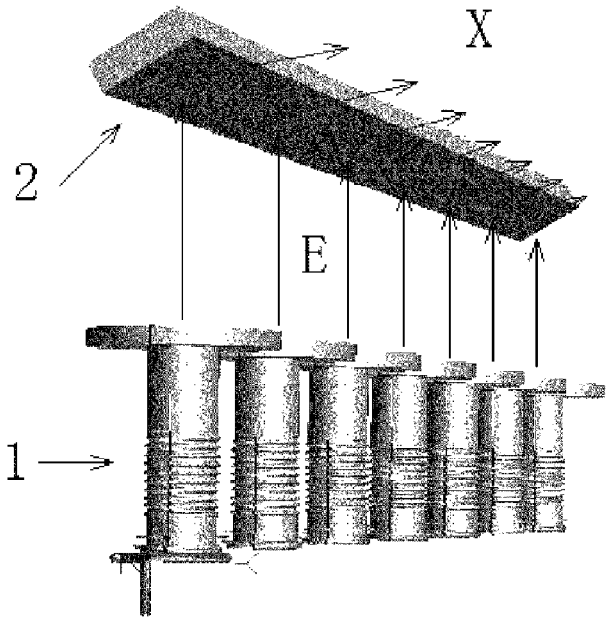
FIG. 2 is a schematic view of the positional relation of the anode and the electron transmitting unit in the present application.

FIG. 2 is a schematic view of the relative positional relation of the anode 2 and the electron transmitting unit 1 of the external thermionic cathode distributed x-ray apparatus in the present application. As shown in FIG. 2, the plurality of electron transmitting units 1 are arranged in a straight line and the anode 2 is in a shape of strip that corresponds to the arrangement of the electron transmitting units 1. In addition, in the direction of length, the anode 2 is parallel to the straightline arranged by the plurality of electron transmitting units 1, and in the direction of width, the surface of anode 2 facing the electron transmitting unit 1 has a predetermined angle with respect to the surface of the electron transmitting unit 1 facing the anode 2.

Figure 3:
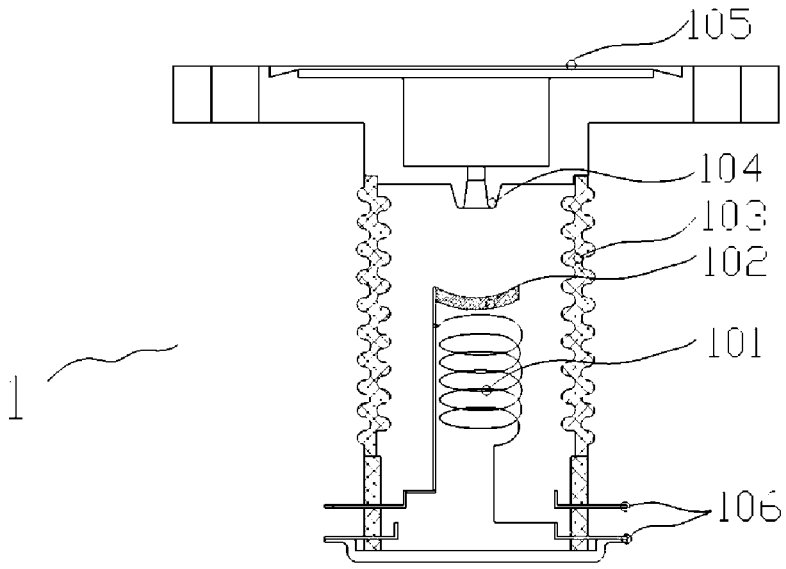
FIG. 3 is a schematic view of the structure of an electron transmitting unit in the present application.

The electron transmitting units 1 are used to generate electron beam current as required and are installed on the side walls of the vacuum box 3 constituting an overall seal structure together with the side wall of the vacuum box 3 by the connecting fastener 105. The electron transmitting unit 1 is located entirely outside the vacuum box 3 and the electron beam current may enter into the vacuum box 3 through the opening at the center of the connecting fastener 105. A structure of electron transmitting unit 1 is shown in FIG. 3. The electron transmitting unit 1 includes a heating filament 101, a cathode 102, an insulated support 103, a focusing electrode 104, a connecting fastener 105, and a filament lead 106. The cathode 102 is connected to the heating filament 101 which is usually made of tungsten filament. Cathode 102 is made of materials of strong capability to thermal transmit electron, such as baryta, scandate, lanthanum hexaborides etc. The insulated support 103 surrounding the heating filament 101 and the cathode 102 is equivalent to part of the housing of electron transmitting unit 1 and are made of insulated material, in most cases ceramic. The filament lead 106 extends to the outside of the electron transmitting unit 1 through the insulated support 103. Between the filament lead 106 and the insulated support 103 is a seal structure. The focusing electrode 104 is located at the upper end of the insulated support 103 and designed as a shape of nose cone with an opening in the center. And the center of the opening is aligned with the center of the cathode 102 vertically. The connecting fastener 105 for seal connecting the electron transmitting unit 1 to the vacuum box 3 is typically a knife edge flange with an opening in the center to allow the electron beam current E to enter into the vacuum box 3 from the electron transmitting unit 1. The insulated support 103, the focusing electrode 104 and the connecting fastener 105 are tightly connected together to make other portions of electron transmitting unit 1 except the centric opening of the connecting fastener 5 to form a vacuum seal structure.

Figure 4:
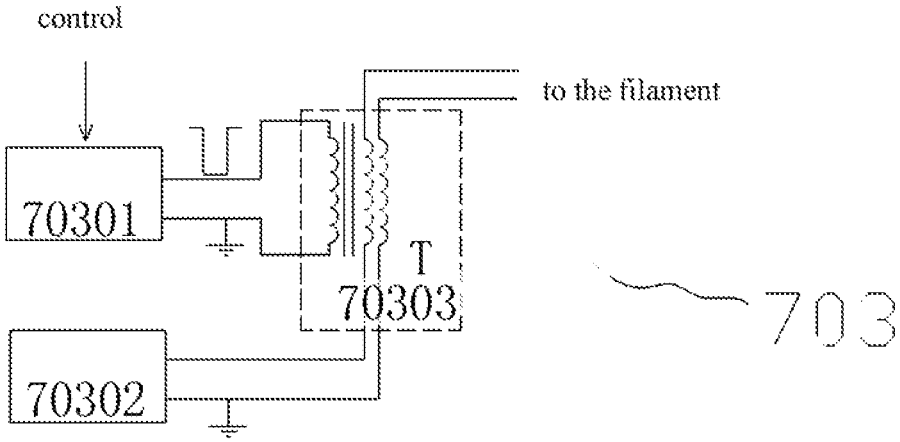
FIG. 4 is a schematic view of the structure of the transmitting control unit in the present application.

In addition, the power supply and control system 7 includes a control system 701, a high voltage power supply 702, a transmitting control apparatus 703 etc. The High voltage power supply 702 is connected to the anode 2 by the high voltage power supply connecting means 4 installed on the wall of the vacuum box 3. The transmitting control apparatus 703 is connected to the filament lead 106 of each electron transmitting unit 1 respectively by the connecting means of the transmitting control means 5. Normally, the number of electron transmitting units 1 is same as that of the transmitting control units. FIG. 4 shows the structure of the transmitting control unit. The transmitting control apparatus 703 includes a plurality of transmitting control units. Each transmitting control unit includes a negative high voltage module 70301, a low voltage direct current module 70302, a high-voltage isolation transformer 70303. The negative high voltage module 70301 is used for generating negative high voltage pulse under the control of control system 701 and the output thereof is connected to the primary side of the high-voltage isolation transformer 70303. The low voltage direct current module 70302 is used for generating the current which energize and heat the filament lead 106 and the output thereof is connected to the low voltage ends of two sets of the secondary sides of the high-voltage isolation transformer 70303 in parallel through transformer winding and output to the filament lead 106 from the high voltage ends of two sets of the secondary sides. The connecting means of the transmitting control means 5 is usually the cable with connector, the number of which is same as that of the electron transmitting unit 1. In addition, the operating condition of the high voltage power supply 702, the transmitting control apparatus 703 may be controlled by the control system 701.

In addition, the vacuum box 3 is a housing of a cavity with its periphery sealed. The interior is high vacuum and the housing is made of insulated materials such as glass or ceramic etc. Multiple electron transmitting units 1 arranged in a straight line are installed at the side wall (c.f. FIG. 1) of the vacuum box 3 and anode 2 in the shape of strip is installed inside (c.f. FIG. 1). The anode 2 is parallel to the orientation of the electron transmitting unit 1 in the direction of length. The space inside the vacuum box 3 is sufficient for the movement of electron beam current in the electric field without any obstruct. The high vacuum inside the vacuum 3 is obtained by baking and venting in the high temperature venting furnace. And the vacuum degree is better than $10^{-3}$ Pa, and the vacuum degree better than $10^{-5}$ Pa is preferred.

In addition, it is preferable that the housing of the vacuum box 3 is made of metal material. In the case of metal material, the electron transmitting unit 1 is seal connected to the wall of the vacuum box 3 at the knife edge flange by its connecting fastener 105 and the anode 2 is fixed installed in the vacuum box 3 using the insulated supporting material. Also, the anode 2 keeps sufficient distance from the housing of the vacuum box 3 such that high voltage sparks will not occur.

In addition, the high voltage power supply connecting means 4 suitable for connecting the anode 2 to the cable of the high voltage power supply 702 is installed on the side wall of vacuum box 3. Normally, the high voltage power supply connecting mean 4 is a taper ceramic structure having metal column inside with one end connected to the anode 2 and the other end tightly connected to the wall of vacuum box 3. Therefore, the whole forms a vacuum seal structure. The metal column inside the high voltage power supply connecting means 4 is used such that the anode 2 is electrically connected to the cable joint of the high voltage power supply 702. Normally, the high voltage power supply connecting means 4 is designed to be pluggable to the cable joint.

Figure 5:
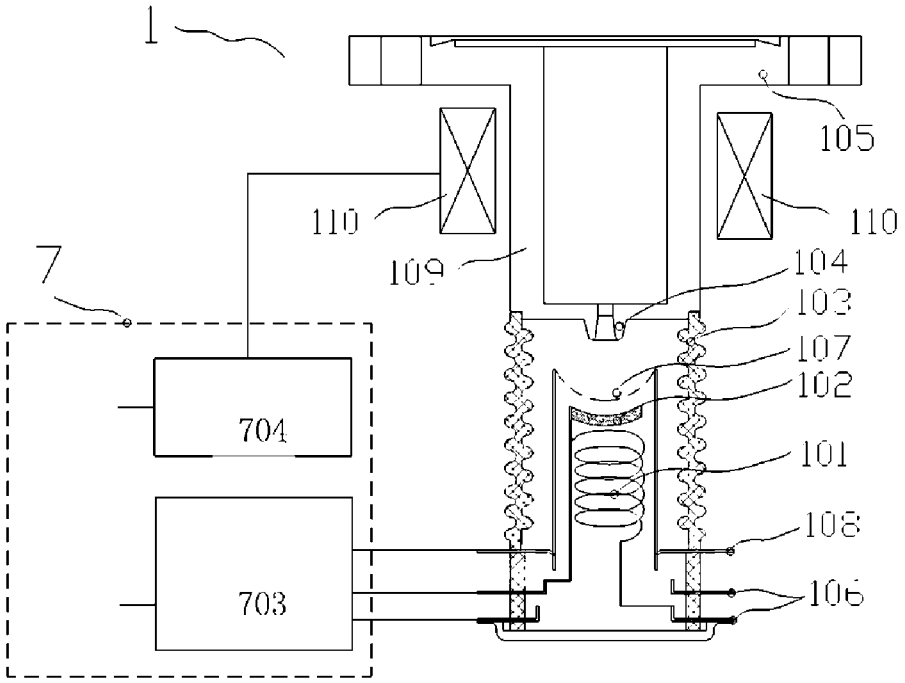
FIG. 5 is a schematic view of the electron transmitting unit having the grid and focusing apparatus in the present application.

In addition, in the external thermionic cathode distributed x-ray apparatus of the present application, the electron transmitting unit 1 may further include the grid 107 and the grid lead 108. FIG. 5 shows a structure of the electron transmitting unit 1 having the grid and focusing apparatus. As shown in FIG. 5, the grid 107 is provided between the cathode 102 and the focusing electrode 104 and adjacent to cathode 102. The grid 107 is typically a mesh the shape of which is usually same as that of the cathode 102. The grid lead 108 is connected to the grid 107 and extended to the outside of the electron transmitting unit 1 through the insulated support 103. The grid lead 108 is seal connected to the insulated support 103 and the grid 108 is connected to the transmitting control apparatus 703 by the connecting means of the transmitting control means 5.

Figure 6:
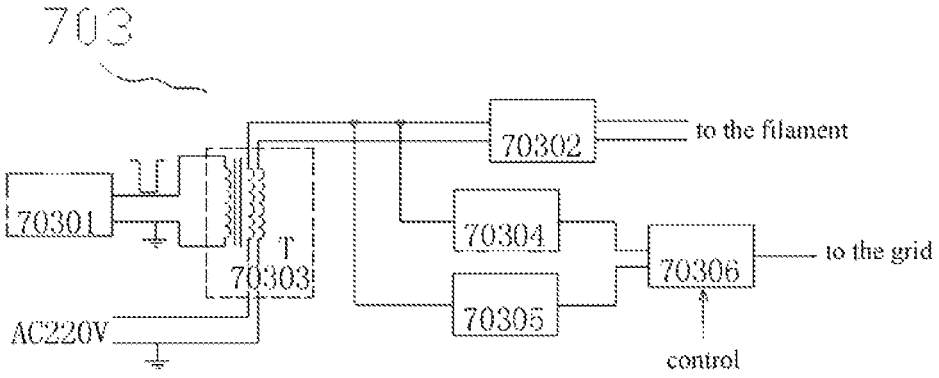
FIG. 6 is a schematic view of the structure of the transmitting control unit having the grid control in the present application.

In addition, in the external thermionic cathode distributed x-ray apparatus of the present application, the transmitting control unit of the transmitting control apparatus 703 may further includes a negative bias voltage module 70304, a positive bias voltage module 70305, and a selecting switch module 70306. FIG. 6 shows a structure of the transmitting control unit having the grid control. As shown in FIG. 6, the negative high voltage module 70301 is used for generating negative high voltage and the output thereof is connected to the primary side of the high-voltage isolation transformer 70303. City power is connected to the low voltage ends of two sets of the secondary sides of the high-voltage isolation transformer 70303 in parallel through transformer winding and output to the power supply suspended on the high voltage from the high voltage end of two sets of the secondary sides in parallel and supplied to the direct current module 70302, the negative bias voltage module 70304 and the positive bias voltage module 70305. The direct current module 70302 generates the current which energize and heat the heating filament 101. The negative bias voltage module 70304 and the positive bias voltage module 70305 generate a negative voltage and a positive voltage respectively and output to the two input ends of the selecting switch module 70306 which select one voltage under the control of the control means 701 and output to the grid lead 108, and finally applied to the grid 107.

In addition, in the external thermionic cathode distributed x-ray apparatus of the present application, the electron transmitting unit 1 may further include the focusing section 109 and focusing means 110. As shown in FIG. 5, the focusing section 109 is connected between the focusing electrode 104 and the connecting fastener 105. The focusing electrode 104, the focusing section 109 and the connecting fastener 105 can be an integral machined from one metal piece or welded together by three metal components. The focusing means 110, typically focusing coil, is installed outside the focusing section 109. The focusing means 110 is connected to the focusing power supply 704 by the connecting means of the focusing means 6 and is driven by the focusing power supply 704. The operating state of the focusing power supply 704 is controlled by the power supply and control system 7. Correspondingly, the external thermionic cathode distributed x-ray apparatus further includes a connecting means of the focusing means 6 and the power supply and control system 7 also includes a focusing power supply 704.

In addition, the external thermionic cathode distributed x-ray apparatus of the present application may further include a vacuum power supply 705 and a vacuum means 8 which includes a vacuum pump 801 and a vacuum valve 802. The vacuum apparatus 8 is installed on the side wall of the vacuum box 3. The vacuum pump 801 works under the effect of the vacuum power supply 705 for maintaining the high vacuum in the vacuum box 3. Usually, when the external thermionic cathode distributed x-ray is operating, the electron beam current bombards the anode 2 which will emit heat and vent a small amount of gas. The gas may be withdrawn rapidly by using the vacuum pump 801 so as to maintain the high vacuum degree inside the vacuum box 3. A vacuum ion pump is preferably used as the vacuum pump 801. All metal vacuum valve which could withstand high temperature baking, e.g. all metal manual gate valve, is typically selected as the vacuum valve 802. Normally, the vacuum valve 802 is in the state of close. Correspondingly, the power supply and control system 7 of the external thermionic cathode distributed x-ray apparatus further includes the vacuum power supply 705 (Vacc PS) of the vacuum means 8.

Figure 7:
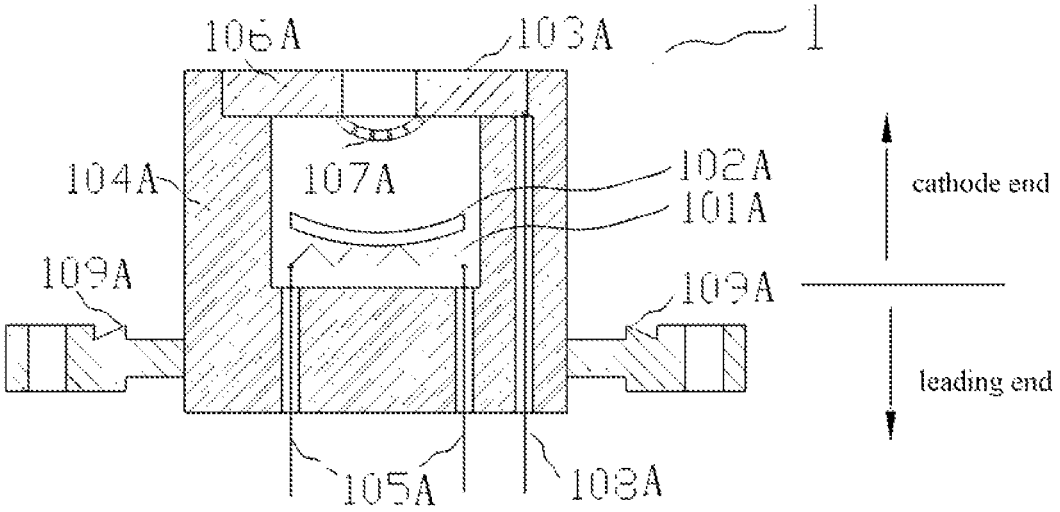
FIG. 7 is a schematic view of the structure of another electron transmitting unit in the present application.

In addition, the electron transmitting units of other structure may be used in the present application. FIG. 7 is a schematic view of the structure of another electron transmitting unit in the present application. As shown in FIG. 7, the electron transmitting unit 1 is composed of a heating filament 101A, a cathode 102A, a grid 103A, an insulated support 104A and a connecting fastener 109A etc.

The electron transmitting unit 1 forms an integral seal structure together with the wall of vacuum box 3 by the connecting fastener 109A. But the embodiments are not limited thereto, as long as the electron transmitting unit 1 is installed on the wall of the vacuum box 3 and it is overall located outside the vacuum box 3 (Namely, the cathode end of the electron transmitting unit 1 (including the heating filament 101A, cathode 102A and the grid 103A) and the lead end of the electron transmitting unit 1 (including the filament lead 105A, the grid lead 108A and the connecting fastener 109A) are located outside the vacuum box 3), other ways of installation may be employed. The electron transmitting unit 1 includes a heating filament 101A, a cathode 102A, a grid 103A, an insulated support 104A, a filament lead 105A, a connecting fastener 109A, and the grid 103A is composed of the grid frame 106A, the grid mesh 107A and the grid lead 108A. The cathode 102A is connected to the heating filament 101A which is usually made of tungsten filament. Cathode 102A is usually made of materials of strong capability to thermal transmit electron, such as baryta, scandate, lanthanum hexaborides etc. The insulated support 104A surrounding the heating filament 101A and the cathode 102A is equivalent to the housing of electron transmitting unit 1 and is made of insulated material, in most cases ceramic. The filament lead 105A extends to the lower end of the electron transmitting unit 1 through the insulated support 104A (the embodiment is not limited thereto as long as the filament lead 105A can extend to the outside of the electron transmitting unit 1). Between the filament lead 105A and the insulated support 104A is a seal structure. Grid 103A is located at the upper end of the insulated support 104A (namely, it is located at the opening of the insulated support 104A) opposing the cathode 102A, preferably grid 103A is aligned with the center of the cathode 102A vertically. Moreover, the grid 103A includes a grid frame 106A, a grid mesh 107A, a grid lead 108A, all of which are made of metal. Normally, the grid frame is made of stainless steel material, grid mesh 107A molybdenum material, and grid lead 108A Kovar (alloy) material. The grid lead 108A extends to the lower end of the electron transmitting unit 1 through the insulated support 104A (the embodiment is not limited thereto as long as the grid lead 108A can extend to the outside of the electron transmitting unit 1). Between the grid lead 108A and the insulated support 104A is a seal structure. The filament lead 105A and the grid lead 108A are connected to the transmitting control apparatus 703.

What's more, in particular, with respect to the structure of the grid 103A, the main body thereof is a piece of metal plate (e.g. stainless steel material), that is the grid frame 106A. An opening is provided at the center of the grid frame 106A, the shape thereof can be square or circular etc. A wire mesh (e.g. molybdenum material) is fixed at the position of opening, namely the grid mesh 107A. Moreover, a lead (e.g. Kovar alloy material), namely the grid lead 108A, extends from somewhere of the metal plate such that the grid 103A can be connected to an electric potential. Additionally, the grid 103A is positioned right above the cathode 102A. The center of the above-mentioned opening of the grid 103A is aligned with the center of the cathode 102A (namely in a vertical line longitudinally). The shape of the opening is corresponding to that of the cathode 102. In usual, the opening is smaller than the area of cathode 102A. However, the structure of the grid 103A is not limited to those described above as long as the electron beam current is able to pass the grid 103A. In addition, the grid 103A is fixed with respect to cathode 102A by the insulated support 104A.

What's more, in particular, with respect to the structure of the connecting fastener 109A, preferably, the main body thereof is a circular knife edge flange with opening provided in the center. The shape of the opening may be square or circular etc. Seal connection can be provided at the opening and the outer edge of the lower end of the insulated support 104A, for example, welding connection. Screw holes are formed at the outer edge of the knife edge flange. The electron transmitting unit 1 can be fixed to the walls of the vacuum box 3 by bolted connection. A vacuum seal connection is formed between the knife edge and the wall of the vacuum box 3. This is a flexible structure easy for disassemble where certain one of multiple electron transmitting units 1 breaks down it can be replaced easily. It should be noted that the connecting fastener 109A functions to achieve the seal connection between the insulated support 104A and the vacuum box 3 and various ways may be employed, for example, transition welding by metal flange, or glass high temperature melting seal connection, or welding to the metal after ceramic metallizing etc.

Figure 8:
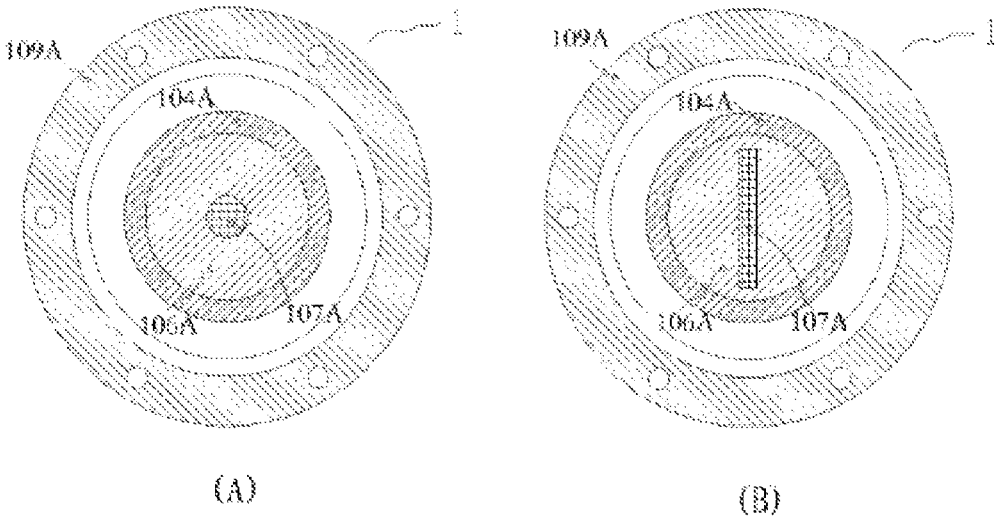
FIG. 8 is a top view of the structure of a cylinder electron transmitting unit in the present application, wherein (A) is the case of circular grid hole and (B) is the case of rectangular grid hole.
Figure 10:
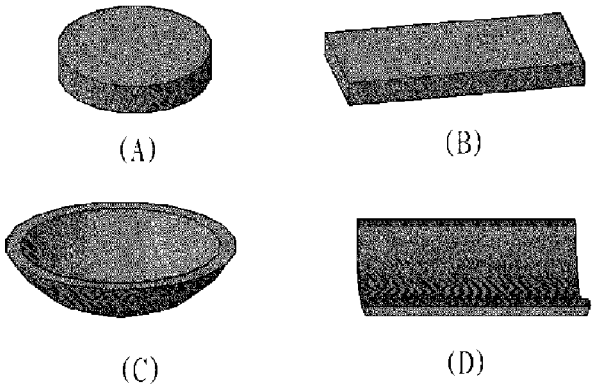
FIG. 10 is a schematic view of the structure of a cathode in the present application, wherein (A) is a flat circular cathode, (B) is a flat rectangular cathode, (C) is a spherical arc cathode, and (D) is a cylindrical surface cathode.

In addition, electron transmitting unit 1 may be a structure of cylinder, that is, the insulated support 104A is cylinder, while cathode 102A, grid frame 106A, grid mesh 107A can be circular simultaneously or be rectangular simultaneously. FIG. 8 is the top view of the structure of a cylinder electron transmitting unit 1, wherein (A) depicts the structure where cathode 102A, grid frame 106A, and grid mesh 107A are circular simultaneously and (B) depicts the structure where cathode 102A, grid frame 106A and grid mesh 107A are rectangular simultaneously. In addition, as to the circular cathode, in order to achieve better focusing effect of the electron generated by the surface of cathode 102A, it typically machines the surface of cathode 102A into spherical arc shape (as shown in FIG. 10(C)). The diameter of the surface of cathode 102A is typically several mm, for example 2 mm in diameter. The diameter of the opening of the grid mesh 107A installed on the grid frame 106A is typically several mm, for example 1 mm in diameter. In addition, the distance from the grid 103A to the surface of the cathode 102A is typically a few tenths of an mm to a few mms, e.g. 2 mm. Moreover, as to rectangular cathode, in order to achieve better focusing effect of the electron generated by the surface of cathode 102A, it typically employs the cylindrical surface to facilitate further converging the electron beam current on the narrow side. Typically, the length of the arc surface ranges from several mm to dozens of mms, and the width is usually several mm, e.g. 10 mm in length and 2 mm in width. Correspondingly, the grid mesh 107A is rectangular, preferably the width thereof is 1 mm and the length thereof is 10 mm. In FIG. 5, four cases are shown in which the cathodes 102A are flat circular, flat rectangular, spherical arc and cylinder arc surface respectively.

Figure 9:
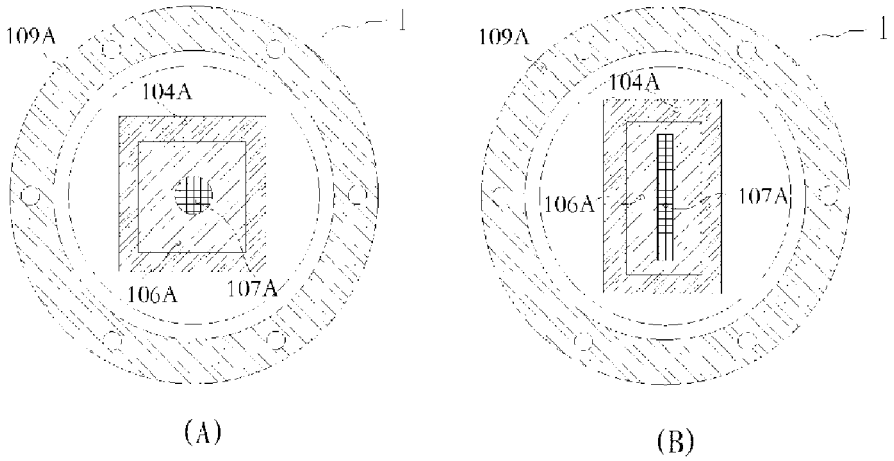
FIG. 9 is a top view of the structure of a cuboid electron transmitting unit in the present application, wherein (A) is the case of circular grid hole and (B) is the case of rectangular grid hole.

In addition, the electron transmitting unit 1 may also be a cuboid structure, namely the insulated support 104A is a cuboid, while the cathode 102A, the grid frame 106A, the grid mesh 107A may be circular simultaneously or rectangular simultaneously. FIG. 9 is the top view of the structure of a cuboid electron transmitting unit 1, wherein (A) depicts the structure where cathode 102A, grid frame 106A, and grid mesh 107A are circular simultaneously and (B) depicts the structure where cathode 102A, grid frame 106A and grid mesh 107A are rectangular simultaneously. It should be noted that twill lines in FIGS. 8 and 9 depict for the purpose of distinguishing various different components, not representing a cross section.

Figure 11:
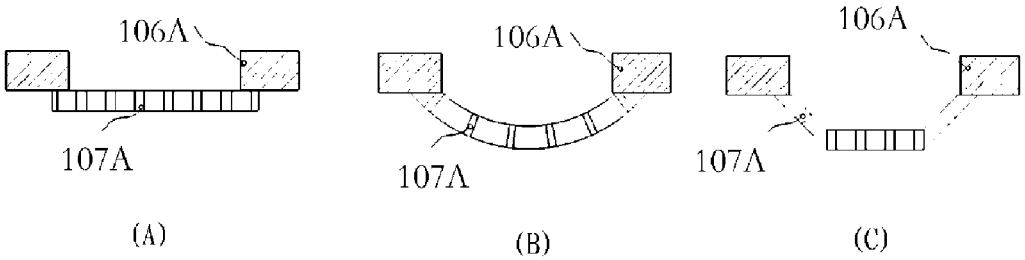
FIG. 11 is a schematic view of the structure of the grid mesh in the present application, wherein (A) is a flat grid mesh, (B) is a spherical grid mesh, and (C) is U-shaped groove grid mesh.

What's more, in particular, with respect to the structure of the grid mesh 107A, as shown in FIG. 11, it can be flat, or spherical or U-shaped groove shape as well. Spherical type is preferable because spherical grid mesh can produce better focusing effect of the electron beam.

Figure 12:
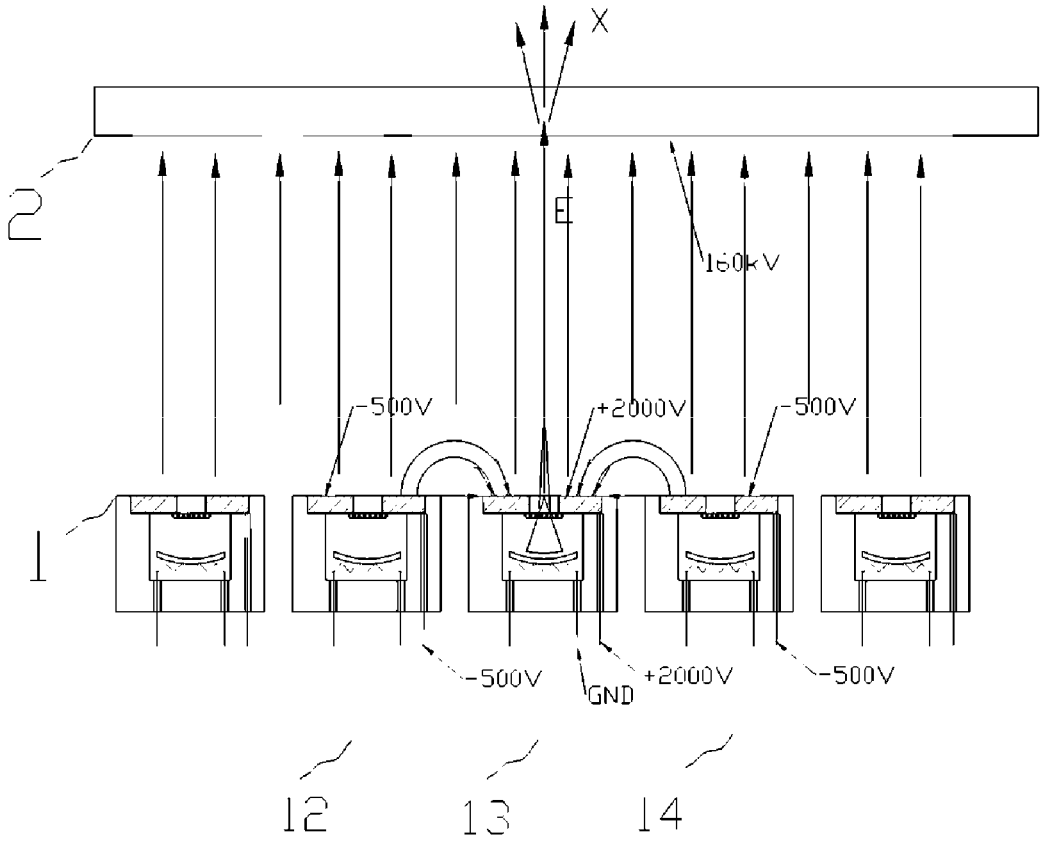
FIG. 12 is a schematic view of automatic focus conducted by employing the grid control of the present application.

In addition, if the transmitting control apparatus 703 only change the state of the grid of one of the adjacent electron transmitting units, at the same time only one of the adjacent electron transmitting units transmits electron forming the electron beam current, the electric field on both sides of the grid of the electron transmitting unit automatically focuses the electron beam current. As shown in FIG. 12, the arrow between the electron transmitting unit 1 and the anode 2 indicates the direction that the electrons move toward (against the direction of power line). In FIG. 12, the voltage of anode 2 is high voltage of +160 kV and the arrow between the electron transmitting unit 1 and the anode 2 in the large electric field directs to the anode 2 from the electron transmitting unit 1. That is to say, as long as the electron transmitting unit 1 transmits the electron beam current, the electron beam current will move toward anode 2. Observing the state of partial electrical field of the surface of the electron transmitting unit 1, in the adjacent electron transmitting units 12, 13 and 14, the voltage of the grid 103A of the electron transmitting unit 13 changes from −500V to +2000V, then electron transmitting unit 13 enters into the electron transmitting state and the voltages of the grids 103A of the adjacent electron transmitting units 12 and 14 remain −500V. If electrons are transmitted by the electron transmitting units 12, 14, the electrons move toward the grid 103A of electron transmitting unit 13 from the grids 103A of the electron transmitting units 12 and 14. However, because electrons are not transmitted by the electron transmitting units 12, 14, the electron beam transmitted by the electron transmitting unit 13 is squeezed by the effect of electric field directing to the adjacent electron transmitting units 12 and 14 from the electron transmitting unit 13, and hence having the automatic focusing effect.

It should be noted that the external thermionic cathode distributed x-ray apparatus of this disclosure is operated in the state of high vacuum. The method for obtaining and maintaining the high vacuum includes: completing installing the anode 2 in the vacuum box 3; completing seal connecting the high voltage power supply connecting means 4 and the vacuum mean 8 to the wall of vacuum box 3; sealing with a blind flange at the side wall of the vacuum box 3 to which the electron transmitting unit is connected firstly so as to form an integral seal structure of the vacuum box 3; then baking the structure in a vacuum furnace to vent gas and connecting the vacuum valve 82 to an external vacuum sucking system so as to vent the gas absorbed by the material of each component; then, in a normal temperature and clean environment, injecting nitrogen into the vacuum box 3 from the vacuum valve 802, thus forming a protected environment; and then open the blind flange at the position where the electron transmitting unit is connected and installing the electron transmitting unit one by one; after all of the electron transmitting units are installed, sucking by the vacuum valve 802 connected to the external vacuum sucking system and baking and venting again to make high vacuum inside the vacuum box 3; the cathode of each electron transmitting unit can be activated during baking and venting; after the baking and venting is finished, closing the vacuum valve 802 to maintain high vacuum in the vacuum 3; during the operating of the external thermionic cathode distributed x-ray apparatus, the small amount of gas generated by the anode is withdrawn out by the vacuum pump 801 so as to maintain high vacuum inside the vacuum box 3. When an electron transmitting unit damages or needs replacement due to the expiry of its service time, nitrogen is injected into the vacuum box 3 from the vacuum valve 802 to establish protection; removing the electron transmitting unit to be replaced and install a new one with the least time; vacuum valve 802 connected to the external vacuum sucking device to draws vacuum to vacuum box 3; when high vacuum is achieved once again in the vacuum box 3, close the vacuum valve 802 to maintain high vacuum inside the vacuum box 3.

Figure 13:
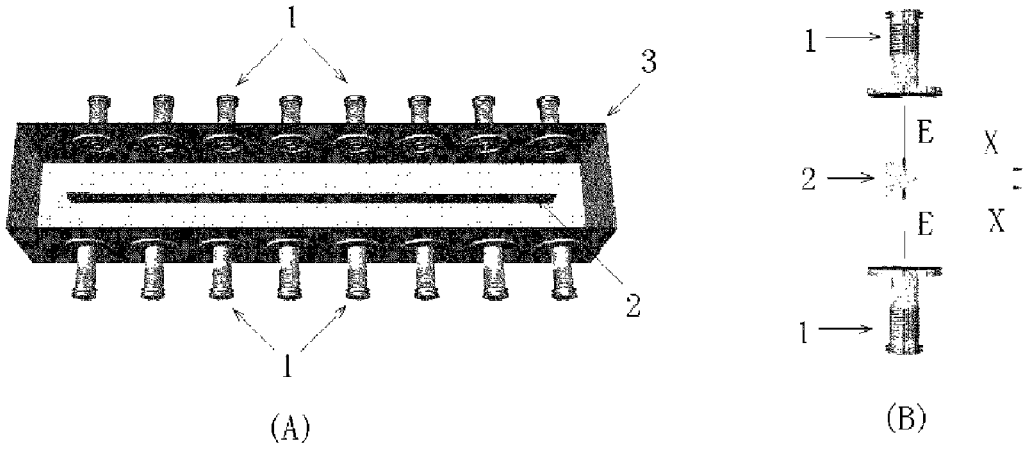
FIG. 13 is a schematic view of the structure of the external thermionic cathode distributed x-ray apparatus arranged in two rows in linear in the present application, wherein (A) depicts the positional relation of the electron transmitting units, the anode and the vacuum box, and (B) depicts the positional relation of the electron transmitting unit and the anode.

In addition, it should be noted that in the external thermionic cathode distributed x-ray apparatus, the electron transmitting units 1 may be arranged on a side wall of the vacuum box 3, or may arranged in the same direction of extension simultaneously on two side walls of the vacuum box 3 opposing to each other. FIG. 13 shows the structure of the external thermionic cathode distributed x-ray apparatus arranged in two rows in linear opposing to each other, wherein (A) depicts the positional relation of the electron transmitting units 1, the anode 2 and the vacuum box 3, and (B) depicts the positional relation of the electron transmitting unit 1 and the anode 2. As shown in FIG. 13(A), a plurality of the electron transmitting units 1 are arranged in two rows on the side walls of the vacuum box 3 opposing to each other respectively and the anode 2 is arranged in the middle of the vacuum box 3. As shown in FIG. 13(B), the surface facing the anode 2 and the surface facing the two rows of the electron transmitting units 1 are all slopes. The electron beam current E generated by the electron transmitting units 1 are accelerated by the electric field between the electron transmitting unit 1 and the anode 2 and bombards the slope of the anode 2 generating x-rays. The transmitting direction of the useful x-rays is the direction of the slope of the anode 2. Because two rows of the electron transmitting units 1 are arranged oppositely, the anode 2 has two slopes generating x-rays transmitted toward the same direction.

Figure 14:
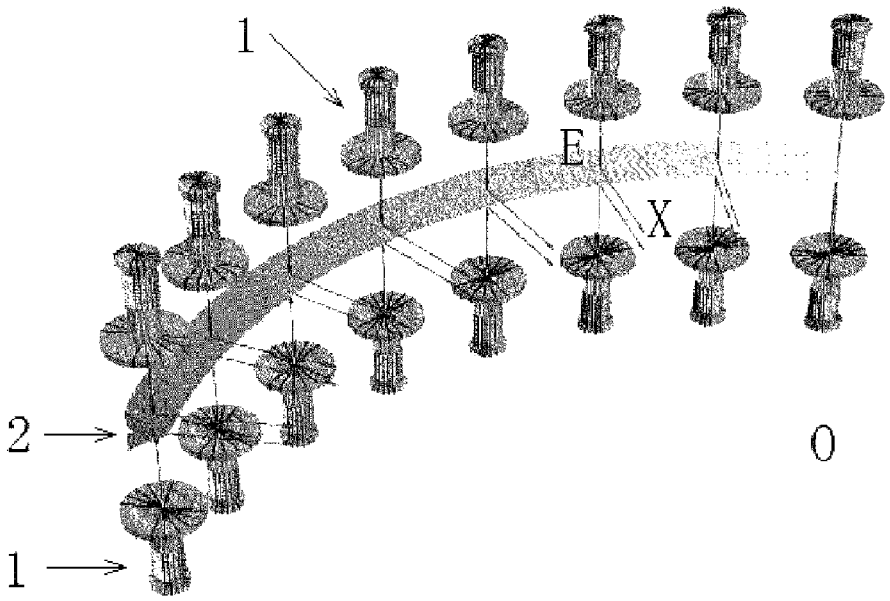
FIG. 14 is a schematic view of the structure of the external thermionic cathode distributed x-ray apparatus arranged in two rows in an arc opposing to each other in the present application.

What's more, it should be noted that the external thermionic cathode distributed x-ray apparatus of this disclosure can be in linear arrangement or cambered arrangement so as to meet different application requirements. FIG. 14 shows a schematic view of the positional relation of the transmitting units 1 and the anode 2 of the external thermionic cathode distributed x-ray apparatus according to the present application. Two rows of the electron transmitting units 1 are arranged along the circumference on two side surfaces of the vacuum box 3 opposing to each other. These two side surfaces are parallel to each other and the electron transmitting units 1 are arranged in an arc along the direction of extension. The size of the arc arranged can be determined as required. The anode 2 is disposed in the middle part of the vacuum box 3, which is between the two rows of the electron transmitting units opposing to each other. The surfaces of the anode 2 facing the two rows of the electron transmitting units 1 are both slopes and the directions of the two slopes are directed to the center O of the arc. The electron beam current E is transmitted from the upper surface of the electron transmitting unit 1 and is accelerated by the high voltage electric field between the anode 2 and the electron transmitting unit 1, and finally bombards the anode 2 forming a series of x-ray target spots arranged in two arcs on the two slopes of the anode 2. Useful transmitting direction of x-ray directs to the center O of the arc. With regards to the vacuum box 3 of the external thermionic cathode distributed x-ray apparatus is arc-shaped or termed as ring-shaped corresponding to the configuration of the electron transmitting unit 1 and the shape of anode 2. The x-rays transmitted by the arc distributed x-ray apparatus are directed to the center O of the arc and are able to be applied to the case that needs the source of ray to be in a circular arrangement.

In addition, it should be noted that in the external thermionic cathode distributed x-ray apparatus, the arrangement of each electron transmitting unit may be linear or segmented linear, such as L-shaped or U-shaped. What's more, the arrangement of each electron transmitting unit may be arc or segmented arc, e.g. curve connected by curved segments of different diameters or the combination of linear segments with curved segments etc.

In addition, it should be noted that in the external thermionic cathode distributed x-ray apparatus, the arrangement space between each electron transmitting unit may be uniform or nonuniform.

Figure 15:
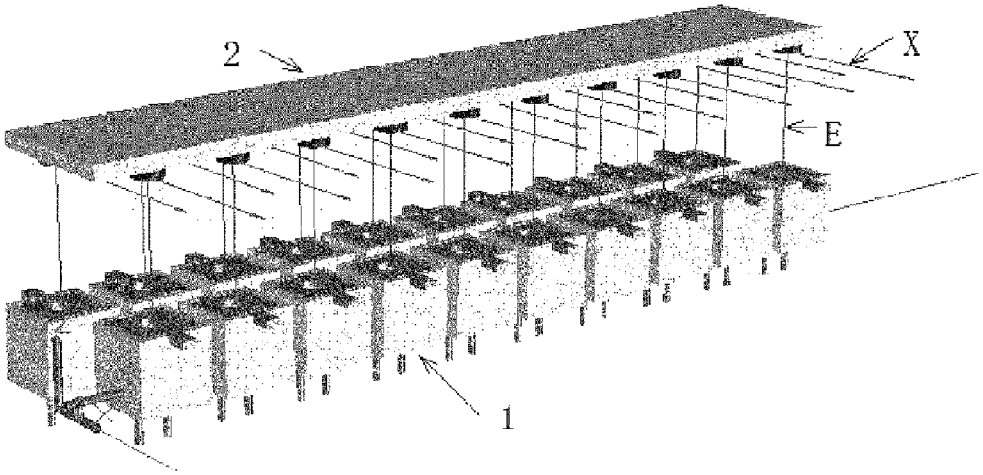
FIG. 15 is a view of the main structure of the two dimensional distributed x-ray apparatus of the present application.
Figure 16:
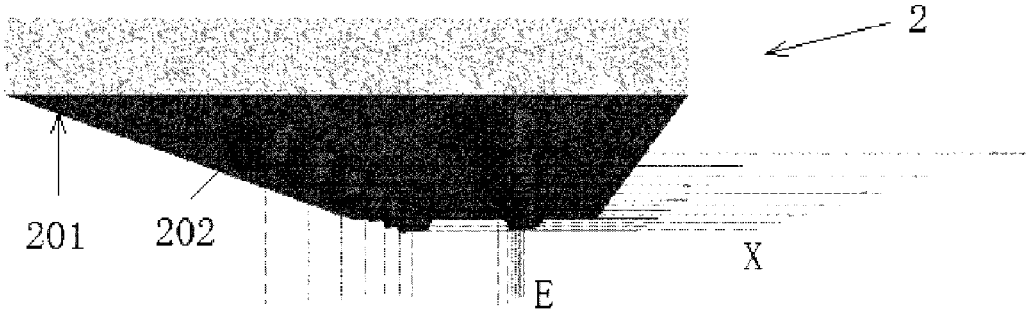
FIG. 16 is a bottom view of the anode structure of the two dimensional distributed x-ray apparatus in the present application.

In addition, in the present application, the electron transmitting units can be configured in a two dimensional array, thereby obtaining a two dimensional array distributed x-ray apparatus. As shown in FIGS. 15 and 16, the two dimensional array distributed x-ray apparatus includes a plurality of electron transmitting units 1 (at least four, hereinafter also specifically referred to as electron transmitting unit 11*a*, 12*a*, 13*a*, 14*a* . . . electron transmitting unit 11*b*, 12*b*, 13*b*, 14*b* . . . ). The electron transmitting unit may be any one of the electron transmitting units described above. The anode 2 includes an anode plate 201 and a plurality of targets 202 arranged on the anode plate corresponding to the electron transmitting units 1. However, the embodiments of the anode 2 are not limited thereto and the conventional anode in the art is also feasible. In addition, the plurality of electron transmitting units 1 are arranged in a plane in a two dimensional array on a side wall of the vacuum box 3 and are parallel to the plane of the anode plate 201. Additionally, as mentioned above, the electron transmitting unit 1 is integrally located outside the vacuum box 3 and the anode 2 is located inside the vacuum box 3.

FIG. 15 shows a schematic view of the structure of the space configuration of the electron transmitting unit 1 and the anode 2 (Herein, the vacuum box 3 is omitted). The electron transmitting units 1 are arranged in two rows on a plane (namely, a side wall of the vacuum box 3). In addition, the electron transmitting units 1 are arranged in a plane in two lines and the front line and the rear line of the electron transmitting units 1 are interlaced (c.f. FIG. 1). But the embodiments are not limited thereto. It is also possible that the front line and the rear line of the electron transmitting units are not interlaced. The targets 202 on the anode 2 are in one-to-one correspondence to the electron transmitting units 1. The upper surface of the target 202 is directed to the electron transmitting units 1. The line from the center of the electron transmitting unit 1 to the center of the target 202 is perpendicular to the plane of the anode plate 201 and this line is also the moving path of the electron beam current E transmitted by the electron transmitting unit 1. The electrons bombard the target, thus generating x-rays. The transmitting direction of useful x-rays is parallel to the plane of the anode plate 201 and each useful x-ray is parallel to each other.

FIG. 16 shows another structure of the anode 2. The anode 2 includes an anode plate 201 and a plurality of targets 202 arranged in a two dimensional array. The anode plate 201 is a flat plate and is made of metal, preferable the heat resisting metal materials. The anode plate is completely parallel to the upper surface of the electron transmitting unit 1. When positive high voltage is applied on the anode 2, normally ranging from dozens of kv to hundreds of kv, typically e.g. 180 kv, the parallel high-voltage electric fields are therefore formed between the anode plate 201 and the electron transmitting unit 1. The target 202 is installed on the anode plate 201, the position of which is respectively arranged corresponding to the position of the electron transmitting unit 1. The surface of the target 202 is usually made of heat resisting heavy metal materials, such as tungsten or tungsten alloy. The target 202 is a structure of circular frustum, with a height of several mm, e.g. 3 mm. The bottom surface with relative large diameter is connected to the anode plate 201. The diameter of the upper surface is relative small, typically several mm, e.g. 2 mm. The upper surface is not parallel to the anode plate 201 and usually has a small angle ranging from several degrees to a degree no more than twenty such that the useful x-rays generated by the electron bombarding can be transmitted. All target 202 are arranged in a way that is consistent with the direction of the slope of the upper surface, that is, the transmitting directions of all useful x-rays are consistent. Such structure design of the target is equivalent to the small projection arose from the anode plate 201. Therefore, the partial distribution of electric field of the surface of the anode plate 201 is changed and an automatic focusing effect is obtained before the electron beam bombarding the target such that the target spot is small which contributes to enhance the equality of the image. In the design of the anode, the anode plate 201 is made of common metal and only the surface of the target 202 is tungsten or tungsten alloy, hence the cost is decreased.

Figure 17:
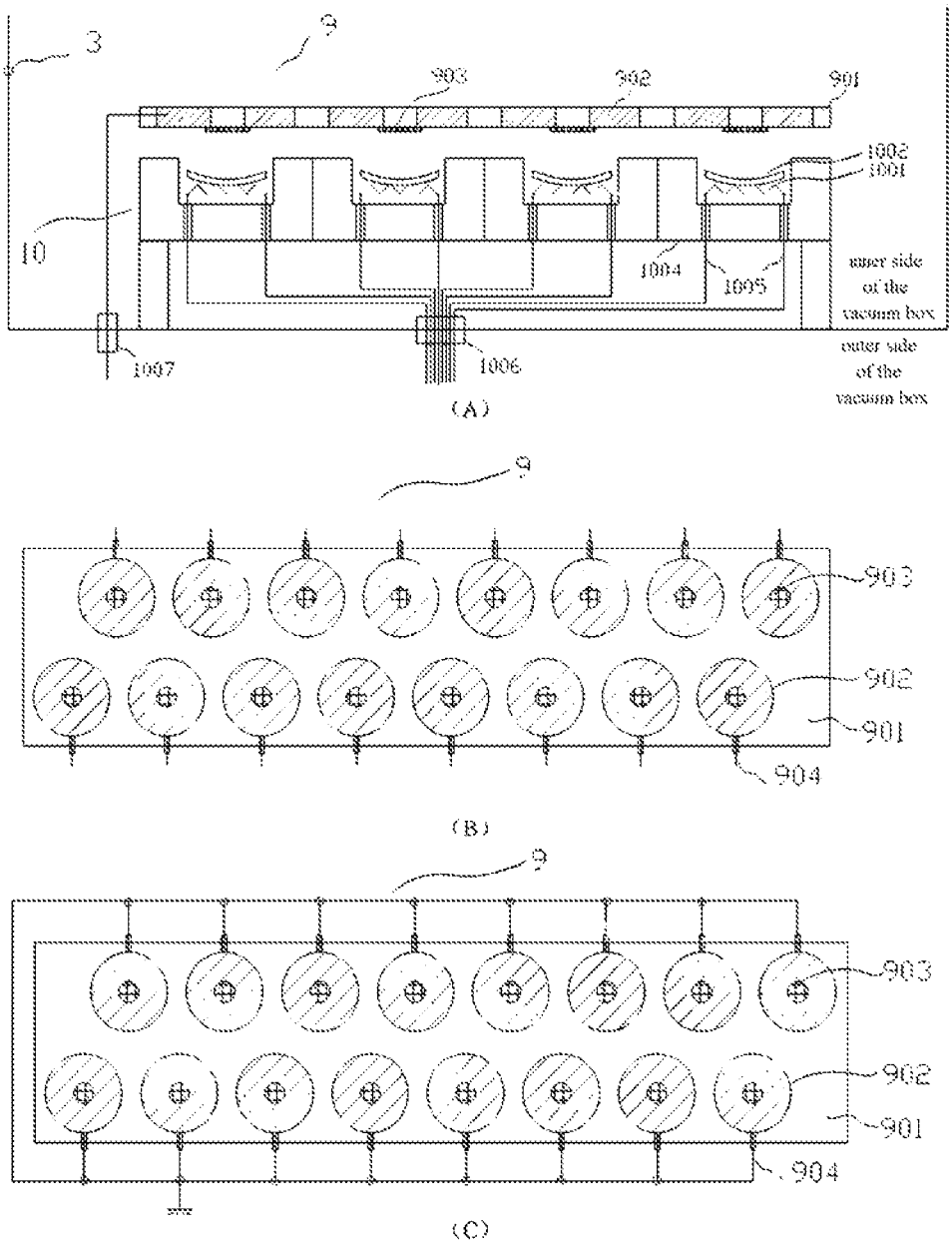
FIG. 17 is schematic view of the electron transmitting unit array with the grid and cathode separated in the present application, wherein (A) is a side view, (B) is a top view of each independent grid control mode, and (C) is a top view of the cathode control mode with each grid interconnected.

In addition, in the present application, the electron transmitting unit can be a structure with the grid and the cathode separated. FIG. 17 shows an array of the electron transmitting units with the grid and the cathode separated. In FIG. 17, the flat grid 9 is composed of an insulated frame plate 901, a grid plate 902, a grid mesh 903 and grid lead 904. As shown in the figure, the grid plate 902 is disposed on the insulated frame plate 901 and the grid mesh 903 is disposed at the position where the opening is formed on the grid plate 902. The grid leads 904 extend from the grid plate 902. An array of the cathodes 10 is composed of multiple cathodes structure arranged tightly. Each cathode structure is composed of a filament 1001, a cathode 1002, an insulated support 1004. The flat grid 9 is located above the cathode array 10 and the distance between the flat grid 9 and the cathode array 10 is very small, typically a few millimeters, e.g. 3 mm. The grid structure composed of the grid plate 902, the grid mesh 903, the grid lead 904 is in one-to-one correspondence with the cathode structure. In addition, observed from the vertical direction, the center of the circle of each grid mesh 903 is coincided with the center of the circle of each cathode 1002.

In addition, as shown in FIG. 17(B), in the present application, the grid structure can be a structure in which each grid lead extends independently and is controlled by the grid-controlled apparatus independently. Each cathode 1002 of the cathode array 10 may be in the same electric potential, e.g. in ground connection. Each grid shifts between the state of hundreds of volts and the state of thousands of volts, for example between −500V to +2000V, so as to control the operating state of each electron transmitting unit. For example, the voltage of a certain grid is −500V at certain moment. The electric field between this grid and the corresponding cathode is a negative electric field and the electrons transmitted from the cathode are limited to the surface of the cathode. At the next moment, the voltage of the grid changes to +2000V, the electric field between this grid and the corresponding cathode changes to a positive electric field and the electrons transmitted from the cathode moves towards the grid and through the grid mesh into the accelerated electric field between the grid and the anode. The electrons are accelerated, and finally bombard the anode generating the x-rays at the corresponding position of the target.

In addition, as shown in FIG. 17C, the grid can be the parallel connection of each grid lead in the same electric potential. The operating state of each electron transmitting unit is controlled by the filament power supply. For example, the voltages of all grids are −500V and each filament of the cathode extends independently. The voltage difference between the two ends of each filament of cathode is constant. The overall voltage of each cathode shifts between the state of 0V and the state of −2500V. At a certain moment, the cathode is in the electric potential of 0V, the electric field between the grid and the cathode is negative and the electrons transmitted from the cathode are limited to the surface of the cathode. At the next moment, the voltage of the cathode changed to −2500V and the electric field between the grid and the corresponding cathode changed to positive. The electrons transmitted from the cathode move toward the grid through the grid mesh into the accelerated electric field between the grid and the anode. The electrons are accelerated, and finally bombard the target generating the x-rays at the corresponding position of the target.

Figure 18:
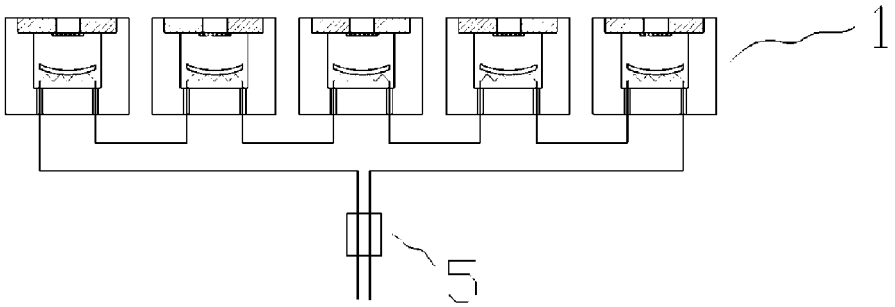
FIG. 18 is a distributed x-rays apparatus with filaments connected in series in the present application.

In addition, in the two dimensional distributed x-rays apparatus of this disclosure, the filament lead of each electron transmitting unit can be each output end connected to the filament power supply respectively and independently or one output end connected to the filament power supply after a series connection. FIG. 18 shows a schematic view in which the filament lead of the electron transmitting unit is connected to the filament power supply in series. In the system where the filament leads of electron transmitting unit are connected in series, typically the cathodes are in the same electric potential. Each grid lead should extend independently and the operating state of the electron transmitting unit is controlled by the grid-controlled apparatus.

In addition, in the present application, the array of the electron transmitting unit can be two rows or multiple rows.

In addition, in the present application, the target of the anode can be frustum of a cone, or a cylinder, or a quadrate platform, or multi-edge platform as well as other polygon protrusions or irregular protrusion etc.

In addition, in the present application, the upper surface of the target of the anode can be a plane, a slope, a spherical surface or other irregular surface.

In addition, in the present application, the configuration of the two dimensional array may extends in line in both directions, or may extends in line in one direction and extends in an arc in the other direction, or may extends in line in one direction and extends in segmented line in the other direction, as well as extends in line in one direction and extends in a segmented arc in the other direction or other ways in combination.

In addition, in the present application, the configuration of the two dimensional array may space uniformly in both directions, or may space uniformly in each direction but the spaces of two directions are different, or may space uniformly in one direction but non-uniformly in the other direction, or may space uniformly in neither direction.

Figure 19:
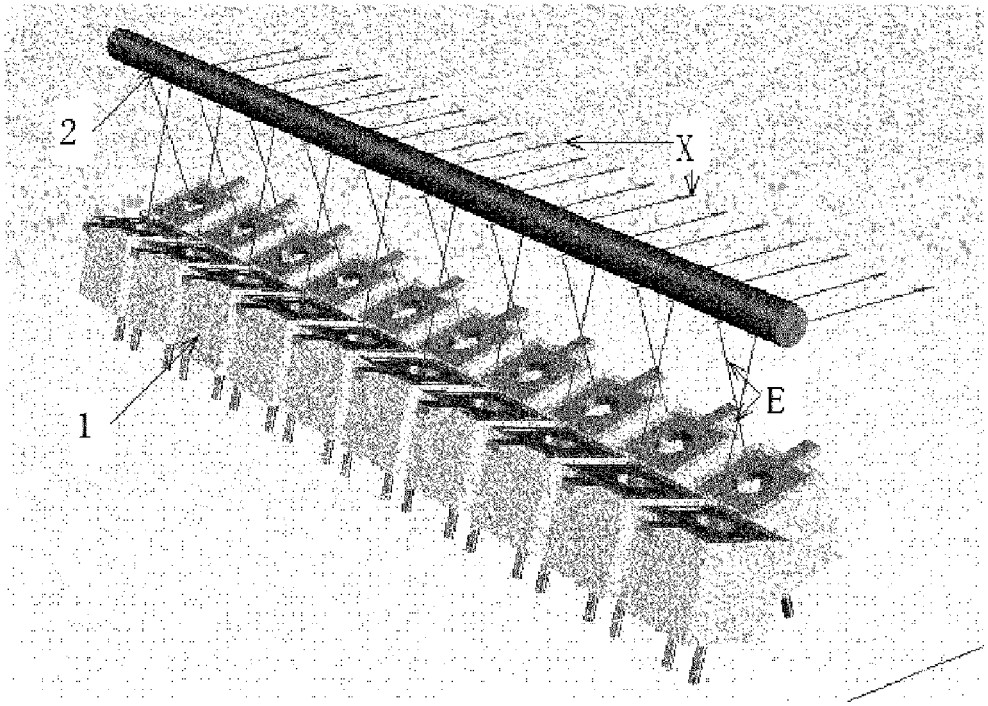
FIG. 19 is a schematic view of the structure of the curved surface array distributed x-ray apparatus of the present application.
Figure 20:
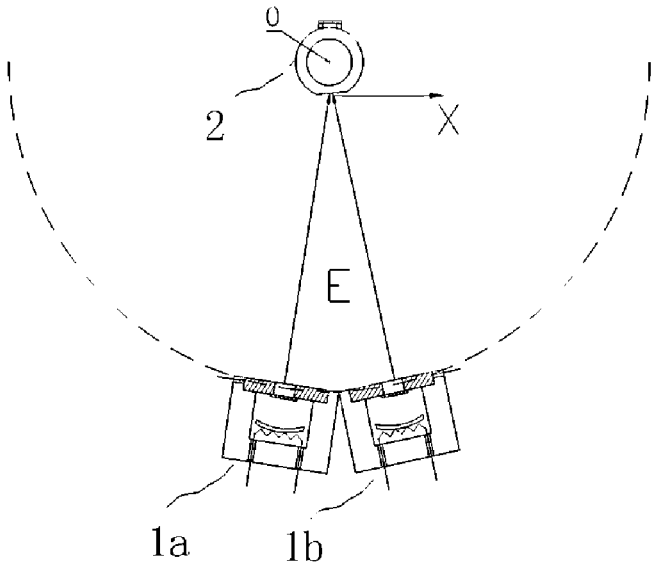
FIG. 20 is a schematic view of the end surface of the structure of the curved surface array distributed x-ray apparatus of the present application.
Figure 21:
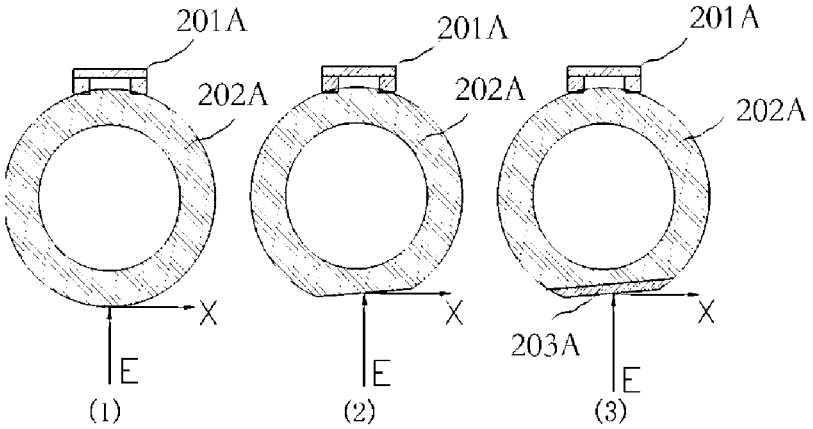
FIG. 21 is a schematic view of the different structure of the anode of the present application.

In addition, in the present application, the electron transmitting unit can be arranged in a curved surface array, thereby obtaining a curved surface array distributed x-ray apparatus. FIG. 19 is a schematic view of the structure of the curved surface array distributed x-ray apparatus of the present application. FIG. 20 is a schematic view of the end surface of the structure of the curved surface array distributed x-ray apparatus of the present application. FIG. 21 is a schematic view of the different structure of the anode of the present application.

As shown in the figures, a plurality of electron transmitting units 1 (at least four, hereinafter also specifically referred to as electron transmitting unit 11*a*, 11*b*, 12*a*, 12*b*, 13*a*, 13*b*, 14*a*, 14*b* . . . ) are arranged in multiple rows in the direction of the axis facing the axis O in the curved surface. In addition, as described above, the electron transmitting units 1 are installed on the wall of the vacuum box 3 and are integrally disposed outside the vacuum box 3. The anode 2 is installed inside the vacuum box.

In addition, the above-mentioned curved surface includes a cylinder surface and an annulus surface. FIG. 20 is a schematic view of the end surface of the structure inside the curved surface array distributed x-ray apparatus of the present application. In particular, FIG. 20 shows a schematic view of the structure inside the cylinder surface array distributed x-ray apparatus of the present application. The electron transmitting units 1 are arranged in multiple rows in the direction of the axis in the cylinder surface and the upper surface (the surface transmitting electrons) of the electron transmitting unit 1 faces the axis O. The anode 2 is arranged on the axis O of the cylinder. Usually, the electron transmitting units 1 are in the same low electric potential, and the anode 2 is in a high electric potential. A positive electric field is formed between the anode 2 and the electron transmitting unit 1. The electric field converges from the surface of each electron transmitting unit 1 to the axis of the anode 2. The electric beam current E moves toward the anode 2 from the electron transmitting unit 1 bombarding the anode 2, and finally generates x-rays.

In addition, the above-mentioned electron transmitting unit 1 can arranged in multiple rows in the direction of the axis facing the axis in the curved surface. The front rows and the rear rows of the multiple rows of the electron transmitting units may be aligned, but preferably they are offset such that the positions where the electron beams generated by each electron transmitting unit bombard the anode are not coincided.

In addition, the anode 2 has a hollow pipe structure in which the coolant is movable. FIG. 21 shows a structure of the anode and the support thereof according to the present application. The anode 2 is composed of an anode support 201A, an anode pipe 202A, and an anode target surface 203A. The anode support 201A is installed on the anode pipe 202A and connected to the top end (small end) of the high voltage power supply connecting means 4 for supporting and fixing the anode 2. The anode pipe 202A is a main structure of the anode 2. Both ends of the anode pipe are connected to one end the cooling connection means 9A and the interior of the anode pipe is communicated with the cooling connection means 9A forming a passageway in which the coolant flows circularly. The anode pipe 202A is typically made of the heat resisting metal materials and has various structures, preferably circular. In addition, in some cases, for example in the case that the thermal power of the anode is relatively small, the anode 2 may also be not a hollow cylinder pipe structure. In addition, the anode target surface is the position where the electron beams bombard the anode pipe 202A which has various design in subtle structure. For example, as shown in FIG. 21(1), the outer round face of the anode pipe 202A is the position where the electron beams bombard. In this case, the anode pipe 202A is integrally made of the heat resisting heavy metal, such as tungsten or tungsten alloy. As shown in FIG. 21(2), a small sloping plane is formed by cutting a portion of the excircle of the anode pipe 202A. The sloping plane becomes the bombarding position of the electron beam, and the sloping direction of the sloping plane is the transmitting direction of the useful x-rays. Such design of the structure contributes to transmit the useful x-ray in the same direction. Preferably, as shown in FIG. 21(3), an anode target surface 203A is specifically provided to the outer surface of the anode pipe 202A. The anode target surface 203A is made of heat resisting heavy metal, such as tungsten or tungsten alloy with a thickness no less than 20 μm (micrometer) fixed to the small sloping plane machined by the outer edge of the anode pipe 202A via electroplating, pasting, welding or other ways. In such cases, the anode pipe 202A may be made of common metal materials such that the cost can be decreased.

Figure 22:
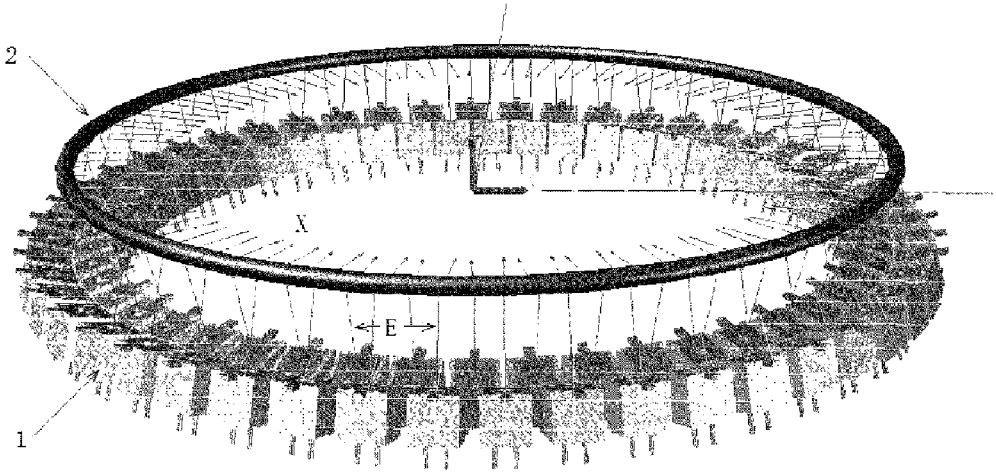
FIG. 22 is a schematic view of the configuration of electron transmitting unit and the anode of the annular-shaped distributed x-ray apparatus in the present application.

In addition, in the present application, the axis described above may be a straight line or an arc, rendering the overall to be a linear distributed x-ray apparatus or an annular distributed x-ray apparatus, so as to meet different application requirements. FIG. 22 shows an effect view of the configuration of electron transmitting unit and the anode of the annular-shaped distributed x-ray apparatus of the present application. The anodes 2 are arranged in a flat circumference and the electron transmitting units 1 are disposed below the anode 2. Two rows of electron transmitting units 1 are arranged in a circle in the direction of anode 2 and arranged in the cambered surface which adopts the center of the anode 2 as the axis, that is to say, the surface of each electron transmitting unit 1 is directed to the axis of the anode 2. The electron beam current E is transmitted from the surface of the electron transmitting unit 1 and accelerated by the high voltage electric field between the anode 2 and the electron transmitting unit 1, and finally bombards the target surface at the lower edge of the anode 2 forming an array of x-ray target spots in circular arrangement on the anode 2. The transmitting direction of useful x-ray is directed to the center of the circle of the anode 2. The vacuum box 3 of the annular distributed x-rays is also in an annular shape corresponding to the configuration of the electron transmitting unit 1 and the shape of the anode 2. The annular distributed x-rays apparatus may be a complete annulus or a section of the annulus and may be applied to the occasions where the x-rays needs being arranged in a circle.

In addition, in the present application, the array of the electron transmitting units may be arranged in two rows or multiple rows.

In addition, in the description of the electron transmitting unit in the present application, 'independently' refers to that each electron transmitting unit is capable of transmitting the electron beam independently. With regards to the specific structure, it may be a separated structure or may be a certain kind of coupled structure.

In addition, in the description of the curved surface array distributed x-ray apparatus of the disclosure, 'curved surface' refers to various forms of curved surfaces, including the cylinder surface, the annular surface, the ellipse surface, or the curved surface composed by segmented straight lines, for example, the surface of the regular polygon column, or the curved surface composed by segmented arcs, preferably the cylinder surface and the annular surface as mentioned above.

In addition, in the description of the curved surface array distributed x-ray apparatus of the disclosure, 'axis' refers to a real axis or an axis in form of the curved surface in which the electron transmitting units are disposed. For example, the axis of the cylinder surface refers to the central axis of the cylinder, and the axis of the annulus surface refers to the central axis inside the annulus. The axis of the elliptic surface refers to the axis adjacent to the paraxial of the ellipse, and the axis of the surface of the regular polygon column refers to the axis composed by the center of the regular polygon.

In addition, in the present application, the cross-section of the pipe inside the anode may be a circular hole, a square hole, a polygon hole, a hole in the shape of an internal gear with heat dispersion fin, or other shape that can increase the radiating area.

In addition, in the present application, the curved array of the electron transmitting unit is configured such that in one direction it is arranged in arc and in the other direction it is arranged in a straight line or segmented lines, in arc or segmented arcs, or in the combination of line segments and arc segments.

In addition, in the present application, the configuration of the curved array configuration may space uniformly in both directions, or may space uniformly in each direction but the spaces of two directions are different, or may space uniformly in one direction but non-uniformly in the other direction, or may space uniformly in neither direction.

In addition, in the present application, the configuration of the vacuum box may integrally be a cuboid body, a cylinder body, an annulus body, or other structure that does not hinder the opposing configuration of the electron transmitting unit and the anode.

Embodiments (System Configuration)

As shown in FIG. 1-6, the external thermionic cathode distributed x-ray apparatus of this disclosure includes a plurality of electron transmitting unit 1, an anode 2, a vacuum box 3, a high voltage power supply connecting means 4, a connecting means of the transmitting control means 5, a connecting means of the focusing means 6, a vacuum means 8 and a power supply and control system 7. The plurality of electron transmitting units 1 are installed on a side wall of the vacuum box 3 in a liner arrangement. Each electron transmitting unit 1 is independent to each other. The anode 2 in a shape of strip is installed in the middle portion of the vacuum box 3. In the direction of linear arrangement, anode 2 is parallel to the alignment of the electron transmitting unit 1. In the vertical cross section of the linear arrangement, there is a small angle between the anode 2 and the upper surface of the electron transmitting unit 1. The electron transmitting unit 1 includes a heating filament 101, a cathode 102, a grid 107, an insulated support 103, a focusing electrode 104, a focusing section 109, a connecting fastener 105, a filament lead 106, a grid lead 108 and a focusing means 110. The high voltage power supply connecting means 4 is installed to the side wall of the vacuum box 3, the interior thereof is connected to the anode 2 and the exterior thereof is pluggable to the high voltage cable. The filament lead 106 and the grid lead 108 of each electron transmitting unit 1 are connected to each transmitting control unit of the transmitting control apparatus 703 by the connecting means of the transmitting control means 5. The vacuum means 8 including a vacuum pump 801 and a vacuum valve 802 is installed on the side wall of the vacuum box 3. The power supply and control system 7 includes multiple modules including a control system 701, a high voltage power supply 702, a grid-controlled apparatus 703, a focusing power supply 704, a vacuum power supply 705 etc., those of which are connected to the components of the system including the heating filaments 101 of multiple electron transmitting units 1, grid 107 and anode 2, vacuum means 8 etc by power cable and controlling cable. The transmitting control apparatus 703 is composed of multiple (the number is same as the number of the electron transmitting unit 1) identical transmitting control units. Each transmitting control unit is composed of a negative high voltage module 70301, a direct current module 70302, a high-voltage isolation transformer 70303, a negative bias voltage module 70304, a positive bias voltage module 70305, and a selecting switch 70306.

(Operating Principle)

In the external thermionic cathode distributed x-ray apparatus of this disclosure, the power supply and control system 7 controls the filament power supply 704, the transmitting control apparatus 703 and the high voltage power supply 702. Each unit of the transmitting control means 703 begins to work. The negative high voltage module 70301 generates the negative high voltage output to the primary side of the high-voltage isolation transformer 70303 such that one set ends of the secondary sides of the high-voltage isolation transformer 70303 in parallel is suspended on the high voltage. That is to say, the direct current module 70302, the negative bias voltage module 70304, the positive bias voltage module 70305 and the selecting switch 70306 are under the same negative high voltage. The direct current module 70302 generates a direct current suspended on this negative high voltage to supply to the heating filament 101. The cathode 102 is heat to a high temperature (e.g. 500-2000° C.) transmitting state by the heating filament 101 and a large number of electrons are generated at the surface of the cathode 102. The negative bias voltage module 70304 and the positive bias voltage module 70305 generate a negative voltage and a positive voltage suspended on the negative high voltage respectively. The selecting switch 70306 usually gate connect the negative voltage to the grid 107. In the electron transmitting unit 1, the filament 101, the cathode 102 and the grid 107 are all under the negative high voltage, typically negative thousands of volt to dozens of kilovolts. And the focusing electrode 104 is connected to the focusing section 109 and connected to the side wall of the vacuum box 3 by the connecting fastener 105 and in the ground potential. Therefore, a small accelerating electric field is formed between the grid 107 and the focusing electrode 104. However, the grid 107 has a lower negative voltage relative to the cathode 102. Therefore, the electrons generated by the cathode 102 cannot pass through grid 107 and are limited to the surface of the cathode 102 by the grid 107. Anode 2 is in a much high positive voltage, e.g. positive dozens of KV to hundreds of KV, due to the high voltage 702, and a positive large accelerating electric field is formed between the electron transmitting unit 1 (namely the side wall of the vacuum box 3, typically in ground potential) and the anode 2.

In the case that needs generating x-ray, the output of the selecting switch 70306 of a certain transmitting control unit of the transmitting control apparatus 703 is converted from negative voltage to positive voltage by the power supply and control system 7 following instruction or preset program. The output signal of the selecting switch 70306 of each transmitting control unit connected to each electron transmitting unit 1 respectively is converted in accordance with the time sequence. For example, at the moment 1, the output of the selecting switch 70306 of the first transmitting control unit of the transmitting control apparatus 703 is changed from negative voltage to positive voltage. In the corresponding electron transmitting unit 11, the electric field between the grid 107 and the cathode 102 is changed to positive. The electrons move to the grid 107 from the surface of the cathode 102 and enter into the accelerating electric field between the grid 107 and the focusing electrode 104 through the grid mesh. Thus, the electrons are accelerated for the first time. The shape of nose cone of the focusing electrode 104 makes the electron beam aggregate automatically during the first acceleration and the diameter of the electron beam becomes smaller. After the electron beam enters into the interior of the focusing section 109, it is under the effect of focusing magnetic field applied by the external focusing means 110, and the diameter of the electron beam further decreases. The electron beam of small diameter enters into the interior of the vacuum box 3 through the opening of the center of the connecting fastener 105 and is accelerated by the large accelerating electric field between the electron transmitting unit 11 and the anode 2, thus obtaining energy and bombarding the anode 2. A target spot 21 is generated on the anode 2 and x-rays are transmitted at the position of target spot 21. At the moment 2, the output of the selecting switch 70306 of the second transmitting control unit of the transmitting control apparatus 703 is converted from negative voltage to positive voltage. Corresponding electron transmitting unit 12 transmits electron generating target spots 22 on the anode 2 and x-rays are transmitted at the position of target spot 22. At the moment 3, the output of the selecting switch 70306 of the third transmitting control unit of the transmitting control apparatus 703 is converted from negative voltage to positive voltage. Corresponding electron transmitting unit 13 transmits electron generating target spots 23 on the anode 2 and x-rays are transmitted at the position of target spot and that cycle repeats. Therefore, the power supply and control system 7 makes each electron transmitting unit 1 work alternately to transmit electron beam following a predetermined time sequence and generate x-rays alternately at different positions of anode 2 so as to become the distributed x-ray source.

The gas generated when the anode 2 is bombarded by the electron beam current is drawn out by the vacuum means 8 in real time, and a high vacuum is maintained in the vacuum box 3, thus facilitating the stable operation for a long time. In addition to control each power supply to drive each component working coordinately following the preset program, the power supply and control system 7 also can receive external command by the communication interface and the human-computer interface and modify and set key parameters of the system as well as update the program the adjust automatic control.

In addition, the external thermionic cathode distributed x-ray apparatus of this disclosure can be applied to CT device so as to obtain a CT device of good stability, excellent reliability and high efficiency for inspection.

(Effects)

The disclosure mainly provides an external thermionic cathode distributed x-ray apparatus generating x-rays changing the focus position periodically in a predetermined sequence in a light source device. By employing the thermionic cathode, the electron transmitting unit of this disclosure has the advantages of larger transmitting current, longer service life. A plurality of electron transmitting units are fixed to the vacuum box respectively and the pint-sized diode gun or triode gun may be used directly. The apparatus of this disclosure enjoys a mature technology, a low cost and a flexible application. The overheat of the anode is remitted by employing the design of big anode in the shape of strip thus improving the power of the light source. The electron transmitting units can be in a linear arrangement rendering the overall to be a linear distributed x-ray apparatus or in an annular arrangement rendering the overall to be an annular distributed x-ray apparatus, so as to have flexible applications. By the design of the focusing electrode and the external focusing apparatus, the electron beam can realize a very tiny focus. Compared with other distributed x-ray light source device, the one in this disclosure has the advantages of large current, small target spot, uniform target spots and high repeatability, high output power, simple structure, convenient control and low cost.

In addition, applying the external thermionic cathode distributed x-ray apparatus to the CT device, multiple visual angles can be generated without moving the light source, and therefore the movement of slip ring could be omitted. This contributes to simplify the structure, enhance the stability and reliability of the system, hence increasing the efficiency of inspection.

Embodiments have been disclosed above for the purpose of illustration but are not limited thereto. It should be appreciated that various modifications and combination are possible without departing from the scope and spirit of the accompanying claims.

LIST OF REFERENCE NUMBERS

1: electron transmitting unit
2: anode;
3: vacuum box;
4: high voltage power supply connecting means;
5: connecting means of the transmitting control means;
6: connecting means of the focusing means;
7: power supply and control system;
8: vacuum means;
E: electronic beam current;
X: x-ray;
O: the center of the arc;
101: heating filament;
102: cathode;
103: insulated support;
104: focusing electrode;
105: connecting fastener;
106: filament lead;
107: grid;
108: grid lead;
109: focusing section;
110: focusing means;
701: control system;
702: high voltage power supply;
703: transmitting control apparatus;
704: focusing power supply;
70301: negative high voltage module;
70302: direct current module;
70303: high-voltage isolation transformer;
70304: negative voltage module;
70305: positive voltage module;
70306: switch module;
801: vacuum pump;
802: vacuum valve;

The invention claimed is:

1. An x-ray apparatus, comprising:

a vacuum box which is sealed at its periphery, wherein the interior thereof is in vacuum;

a plurality of electron transmitting units arranged in an array and installed on a side wall of the vacuum box, wherein each electron transmitting unit is independent to each other; and an anode installed in the center inside the vacuum box, wherein in the direction of length, the anode is parallel to the orientation of the electron transmitting units, and in the direction of width, the anode has a predetermined angle with respect to the plane of the electron transmitting units, wherein each electron transmitting unit is located outside the vacuum box, and each electron transmitting unit is configured to bombard the anode with electron beam current so as to transmit x-rays at a position of a target spot on the anode.

2. The x-ray apparatus according to claim 1, wherein the anode comprises a curved surface, and wherein the plurality of electron transmitting units installed on the side wall of the vacuum box is arranged in multiple rows along a longitudinal extent of the anode, the plurality of electron transmitting units facing the curved surface of the anode.

3. The x-ray apparatus according to claim 2, further comprises:

a power supply and control system having a high voltage power supply connected to the anode, a transmitting control means connected to each of the plurality of electron transmitting units;

a control system for controlling each power supply, wherein the anode is parallel to the orientation of the electron transmitting units in the direction of length, and in the direction of width, the anode has a predetermined angle with respect to the plane of the electron transmitting units, wherein each of the plurality of electron transmitting units comprising:

a heating filament; a cathode connected to the heating filament;

a filament lead extending from both ends of the heating filament and connected to the transmitting control means;

a grid arranged over the cathode opposing the cathode;

an insulated support having an opening and enclosing the heating filament and the cathode; and a connecting fastener connected to an upper end of the insulated support, and wherein the grid comprising: a grid frame which is made of metal and provided with opening in the center;

a grid mesh which is made of metal and fixed at the position of the opening of the grid frame;

a grid lead, extending from the grid frame and connected to the transmitting control means, wherein:

the grid is arranged on the opening of the insulated support opposing the cathode;

the filament lead and the grid lead extend to the outside of the electron transmitting unit through the insulated support; and the connecting fastener is seal connected to the wall of the vacuum box.

4. The x-ray apparatus according to claim 3, further comprises:

a high voltage power supply connecting means connecting the anode to a cable of the high voltage power supply and installed to the side wall of the vacuum box;

a connecting means of the transmitting control means for connecting the heating filament and the grid lead as well as the transmitting control means;

a vacuum power supply included in the power supply and control system; and a vacuum means installed on the side wall of the vacuum box maintaining high vacuum in the vacuum box utilizing the vacuum power supply.

5. The x-ray apparatus according to claim 3, wherein:

the insulated support is cylinder, and the grid frame, the cathode and the grid mesh are circular; or the insulated support is cylinder, and the grid frame, the cathode and the grid mesh are rectangular; or the insulated support is cuboid, and the grid frame, the cathode and the grid mesh are circular; or the insulated support is cuboid, and the grid frame, the cathode and the grid mesh are rectangular; or the grid mesh is flat, spherical or U-shaped groove.

6. The x-ray apparatus according to claim 2, wherein the anode extends along a straight line or along an arc.

7. The x-ray apparatus according to claim 1, wherein the plurality of electron transmitting units are arranged in a two dimensional array on the side wall of the vacuum box.

8. The x-ray apparatus according to claim 7, wherein the anode comprises:

an anode plate made of metal and parallel to an upper surface of the electron transmitting units; and a plurality of targets arranged on the anode plate and disposed corresponding to the positions of the electron transmitting units, wherein a bottom surface of the target is connected to the anode plate and an upper surface of the target has a predetermined angle with the anode plate.

9. The x-ray apparatus according to claim 1, wherein each of the plurality of electron transmitting units is independent of each other and arranged in a linear array on the side wall of the vacuum box.

10. The x-ray apparatus according to claim 1, further comprising:

a power supply and control system having a high voltage power supply connected to the anode;

a transmitting control means connected to each of the plurality of electron transmitting units; and a control system for controlling each power supply;

wherein each of the plurality of electron transmitting units has:

a heating filament;

a cathode connected to the heating filament;

a filament lead extending from both ends of the heating filament; an insulated support enclosing the heating filament and the cathode;

a focusing electrode, arranged at an upper end of the insulated support by way of locating above the cathode; and a connecting fastener arranged above the focusing electrode and connected to the wall of the vacuum box, wherein the filament lead is connected to the transmitting control means through the insulated support.

11. The x-ray apparatus according to claim 10, further comprising:

a high voltage power supply connecting means connecting the anode to a cable of the high voltage power supply and installed to the side wall of the vacuum box;

a connecting means of the transmitting control means for connecting the heating filament and the transmitting control means;

a vacuum power supply included in the power supply and control system; and a vacuum means installed on the side wall of the vacuum box maintaining high vacuum in the vacuum box utilizing the vacuum power supply.

12. The x-ray apparatus according to claim 10, wherein each of the electron transmitting units further comprises:

a grid arranged above the cathode opposing the cathode, and installed between the cathode and the focusing electrode and adjacent to the cathode; and a grid lead connected to the grid through the insulated support and connected to the transmitting control means.

13. The x-ray apparatus according to claim 10, wherein each of the electron transmitting units further comprises:

a focusing section installed between the focusing electrode and the connecting fastener; and a focusing means arranged enclosing the focusing section.

14. The x-ray apparatus according to claim 13, wherein each of the plurality of electron transmitting units further comprises:

a focusing power supply included in the power supply and control system; and a connecting means of the focusing means for connecting the focusing means and the focusing power supply.

15. The x-ray apparatus according to claim 10, wherein:

the plurality of electron transmitting units are arranged in a straight line or segmented straight line, or the plurality of electron transmitting units are arranged in an arc or segmented arcs; and/or spacings between the plurality of electron transmitting units are uniform or non-uniform.

16. The x-ray apparatus according to claim 1, wherein:

the electron transmitting units are installed in two rows on the two side walls of the vacuum box opposing to each other; and/or the vacuum box is made of glass, ceramic or metal.

17. The x-ray apparatus according to claim 1, wherein each of the plurality of electron transmitting units comprises:

a flat grid composed of an insulated frame plate, a grid plate, a grid mesh and grid lead;

an array of cathodes composed of multiple cathodes structure arranged tightly, wherein each cathode structure is composed of a filament, a cathode connected to the filament, a filament lead extended from both ends of the filament and an insulated support enclosing the filament and the cathode, wherein the grid plate is provided to the insulated frame plate and the grid mesh is disposed at the position on which an opening of the grid plate is formed, wherein the grid lead extends from the grid plate and the flat grid is located above the cathode array, and in the vertical direction, the center of the each grid mesh is coincided with the center of each cathode of the cathode array, wherein the filament lead and the grid lead are connected to a transmitting control means respectively, and wherein the anode comprises: an anode plate made of metal and parallel to an upper surface of the electron transmitting units; and a plurality of targets arranged on the anode plate and disposed corresponding to the positions of the electron transmitting units, wherein a bottom surface of each of the targets is connected to the anode plate and an upper surface of the target has a predetermined angle with the anode plate.

18. The x-ray apparatus according to claim 1, wherein:

the array of the plurality of electron transmitting units is arranged in a straight line in both directions, or in a straight line in one direction and in a segmented line in the other direction; or the array of the plurality of electron transmitting units is arranged in a straight line in one direction and in an arc in the other direction.

19. The x-ray apparatus according to claim 1, wherein the anode comprises:

an anode pipe made of metal and having a hollow pipe shape;

an anode support arranged on the anode pipe; and an anode target surface provided on the outer surface of the anode pipe and facing the plurality of electron transmitting units, wherein the anode target surface is a sloping plane formed by cutting a portion of an excircle of the anode pipe, or the anode target surface is formed by forming heavy metal material tungsten or tungsten alloy on the sloping plane formed by cutting a portion of the excircle of the anode pipe.

20. A computed tomography device, comprising the x-ray apparatus according to claim 1.

21. The x-ray apparatus according to claim 1, wherein each of the plurality of transmitting units is located entirely outside the vacuum box.

* * * * *